US012571182B2

(12) United States Patent
Yamamoto

(10) Patent No.: US 12,571,182 B2
(45) Date of Patent: Mar. 10, 2026

(54) WORK MACHINE

(71) Applicant: SUMITOMO HEAVY INDUSTRIES, LTD., Tokyo (JP)

(72) Inventor: Yasuhiro Yamamoto, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/897,428

(22) Filed: Sep. 26, 2024

(65) Prior Publication Data

US 2025/0034839 A1 Jan. 30, 2025

Related U.S. Application Data

(63) Continuation of application No. PCT/JP2023/013127, filed on Mar. 30, 2023.

(30) Foreign Application Priority Data

Mar. 31, 2022 (JP) ..... 2022-061328

(51) Int. Cl.

| | |
|---|---|
| ***E02F 9/12*** | (2006.01) |
| ***E02F 3/43*** | (2006.01) |
| ***E02F 3/96*** | (2006.01) |
| ***E02F 9/20*** | (2006.01) |
| *E02F 9/22* | (2006.01) |

(52) U.S. Cl.

CPC ..... *E02F 9/123* (2013.01); *E02F 3/435* (2013.01); *E02F 3/964* (2013.01); *E02F 9/2004* (2013.01); *E02F 9/2235* (2013.01); *E02F 9/2285* (2013.01); *E02F 9/2292* (2013.01); *E02F 9/2296* (2013.01)

(58) Field of Classification Search

CPC ..... E02F 9/123; E02F 9/128; F15B 11/024; F15B 2011/0243; F15B 2011/0246; F15B 11/048

See application file for complete search history.

(56) References Cited

U.S. PATENT DOCUMENTS 8,881,519 B2 * 11/2014 Kamimura ..... E02F 9/2228 60/414
9,540,789 B2 * 1/2017 Urbanowicz ..... E02F 3/32
(Continued)

FOREIGN PATENT DOCUMENTS

JP 2002-120990 4/2002
JP 2005-060970 3/2005
(Continued)

OTHER PUBLICATIONS

International Search Report for PCT/JP2023/013127 mailed on May 23, 2023.

*Primary Examiner* — Michael Leslie
(74) *Attorney, Agent, or Firm* — IPUSA, PLLC

(57) ABSTRACT

A work machine includes: a traveling body; a rotating body rotatably mounted on the traveling body; an attachment attached to the rotating body; and a control part. In this work machine, the attachment has a hook for hoisting a load, and, when the load is positioned ahead of the hook in a rotating direction of the rotating body upon deceleration of rotation of the rotating body, the control part executes anti-swing control on the rotation of the rotating body such that the hook is positioned immediately above the load's center of gravity.

10 Claims, 12 Drawing Sheets

(56) References Cited

U.S. PATENT DOCUMENTS

| | | | | |
|---|---|---|---|---|
| 11,162,242 | B2 * | 11/2021 | Kozui | E02F 9/123 |
| 11,236,488 | B2 * | 2/2022 | Nakamura | E02F 9/267 |
| 11,821,167 | B2 * | 11/2023 | Kean | E02F 9/262 |
| 12,030,752 | B2 * | 7/2024 | Minami | G05D 1/43 |
| 2020/0340208 | A1 * | 10/2020 | Kitajima | B66C 23/86 |
| 2022/0010526 | A1 | 1/2022 | Nishi | |

FOREIGN PATENT DOCUMENTS

| | | | | |
|---|---|---|---|---|
| JP | 2021-156085 | | 10/2021 | |
| JP | 2021-187604 | | 12/2021 | |
| WO | WO-2019139102 | A1 * | 7/2019 | B66C 23/94 |
| WO | 2020/203887 | | 10/2020 | |

* cited by examiner

WORK MACHINE

CROSS-REFERENCE TO RELATED APPLICATION

The present application is a continuation filed under 35 U.S.C. 111(a) claiming the benefit under 35 U.S.C. 120 and 365(c) of PCT International Application No. PCT/JP2023/013127, filed on Mar. 30, 2023, and designating the U.S., which is based on and claims priority to Japanese Patent Application No. 2022-061328, filed on Mar. 31, 2022, the entire contents of these applications are incorporated herein by reference.

BACKGROUND OF THE INVENTION

1. Field of the Invention

The present disclosure relates to a work machine.

2. Description of the Related Art

There are excavators in which hooks for hoisting load are attached to attachments. For example, there is an excavator having a switch for switching the excavator's operation mode between excavation mode and craning mode; in craning mode, the excavator's operating speed is reduced during rotating operations to ensure safety.

SUMMARY OF THE INVENTION

One example of the present disclosure provides a work machine that includes: a traveling body; a rotating body rotatably mounted on the traveling body; an attachment attached to the rotating body; and a control part. In this work machine, the attachment has a hook for hoisting a load, and, when the load is positioned ahead of the hook in a rotating direction of the rotating body upon deceleration of rotation of the rotating body, the control part executes anti-swing control on the rotation of the rotating body such that the hook is positioned immediately above the load's center of gravity.

DETAILED DESCRIPTION OF THE PREFERRED EMBODIMENTS

Figure 1:
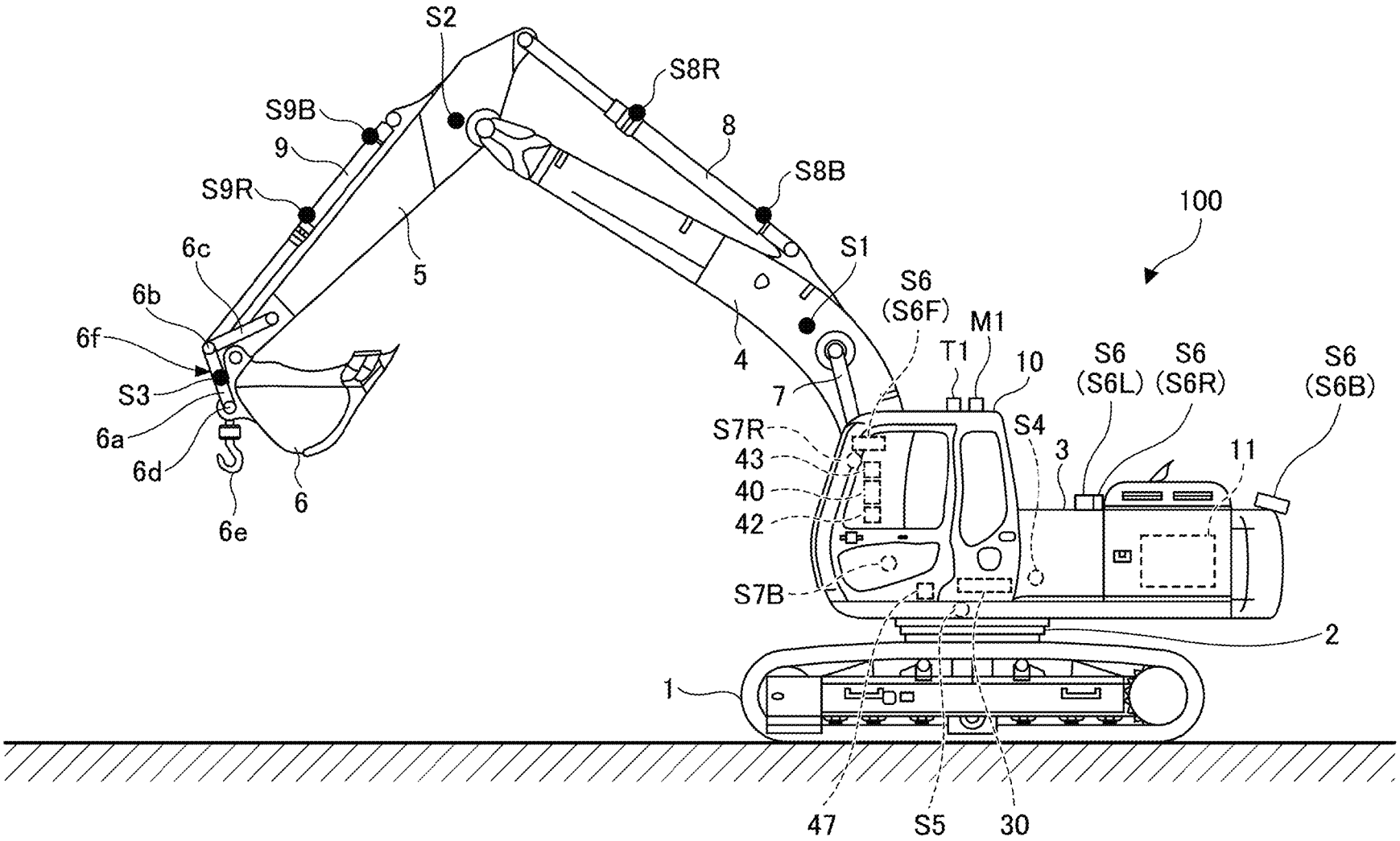
FIG. 1 is a side view of an excavator.

With existing excavators, it is difficult to reduce the sway of load. For example, when an operator tries to prevent or substantially prevent load from swaying in rotating directions by maneuvering an operating device, the operator may have difficulty adjusting the timing and amount of maneuvering the operating device, and might end up causing the load to sway at greater amplitudes.

In view of the foregoing, it is desirable to provide a work machine that can prevent or substantially prevent load from swaying when the work machine makes a rotating motion.

According to the present disclosure, it is possible to prevent or substantially prevent load from swaying when a work machine makes a rotating motion.

Hereinafter, non-limiting embodiments of the present disclosure will be described with reference to the accompanying drawings. Throughout the accompanying drawings, the same or corresponding members or parts will be assigned the same or corresponding reference numerals and not be described twice.

[Overview of Excavator]

First, referring to FIG. 1, an overview of an excavator 100, which is an example of a work machine according to an embodiment, will be described. FIG. 1 is a side view of the excavator 100 that serves as an excavating machine according to the present embodiment.

The excavator 100 according to the present embodiment includes: a lower traveling body 1; an upper rotating body 3 that is mounted on the lower traveling body 1 so as to be rotatable via a rotating mechanism 2; a boom 4, an arm 5, and a bucket 6 that constitute an attachment (work machine); and a cabin 10.

The lower traveling body 1 runs the excavator 100 by a pair of left and right crawlers that are hydraulically driven by drive hydraulic motors 1L and 1R, respectively. (see FIG. 2, which will be described later). In other words, a pair of drive hydraulic motors 1L and 1R (examples of drive motors) drive the lower traveling body 1 (crawlers) as a driven element.

The upper rotating body 3 is driven by the rotating hydraulic motor 2A (see FIG. 2, which will be described below) and rotates relative to the lower traveling body 1. In other words, the rotating hydraulic motor 2A is a rotating drive part that drives the upper rotating body 3 as a driven element, and can change the orientation of the upper rotating body 3.

Note that the upper rotating body 3 may be driven electrically by an electric motor (hereinafter referred to as a "rotating electric motor"), instead of the rotating hydraulic motor 2A. In other words, like the rotating hydraulic motor 2A, the rotating electric motor is a rotating drive part that drives the upper rotating body 3 as a driven element, and can change the orientation of the upper rotating body 3.

The boom 4 is pivotally attached to the front center of the upper rotating body 3 such that the boom can be elevated or lowered. The arm 5 is pivotally attached to the tip of the boom 4 such that the arm 5 can rotate up and down. The bucket 6, which serves as an end attachment, is pivotally attached to the tip of the arm 5 such that the bucket 6 can rotate up and down. A boom cylinder 7, an arm cylinder 8, and a bucket cylinder 9 serve as hydraulic actuators, and hydraulically drive the boom 4, the arm 5, and the bucket 6, respectively.

Note that the bucket 6 is an example of an end attachment, and other end attachments may be attached to the tip of the arm 5, instead of the bucket 6, depending on the job. For example, a slope bucket, a dredging bucket, a breaker, and the like may be attached.

The rod-side end of the bucket cylinder 9 and the bucket 6 are connected by a bucket link 6*a*. To be more specific, the upper end of the bucket link 6*a* is rotatably connected to the rod-side end of the bucket cylinder 9 and an arm link 6*c* via a bucket cylinder top pin 6*b*. The lower end of the bucket link 6*a* is rotatably connected to a bracket on the rear of the bucket 6 via a bucket pin 6*d*.

Also, a craning hook 6*e* is attached to the bucket link 6*a* in a retractable and rotatable manner.

During excavation, the hook 6*e* is stored in a hook accommodating part 6*f*, which is mainly composed of the bucket link 6*a*, so as not to interfere with the operation of the bucket 6. The hook 6*e* is also structured such that its tip protrudes from the hook accommodating part 6*f* during craning.

Also, the hook accommodating part 6*f* may be provided with a detection device that detects the storage state of the hook 6*e* (not shown). For example, the detection device is a switch that is conductive when the hook 6*e* is present in the hook accommodating part 6*f* and that is disconnected when the hook 6*e* is not present in the hook accommodating part 6*f*. The detection device/switch is provided in the hook accommodating part 6*f* in which the hook 6*e* is stored. Note that the detection signal of the detection device is input to a controller 30, which will be described later.

The cabin 10 is the cab in which the operator sits, and is mounted on the front left side of the upper rotating body 3.

[Excavator's Structure]

Figure 2:
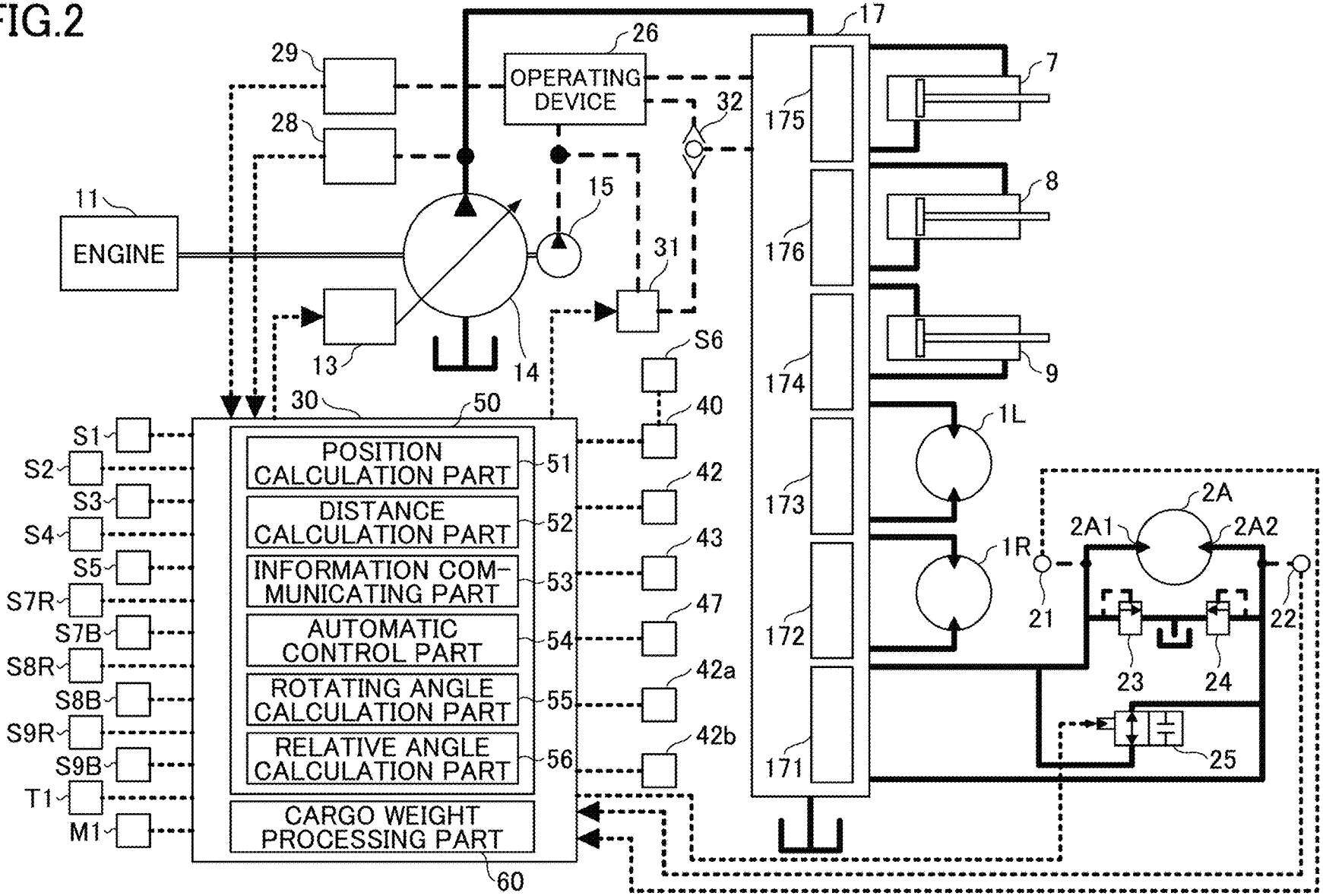
FIG. 2 is a schematic view showing an example structure of an excavator.

Next, the specific structure of the excavator 100 according to the present embodiment will be described with reference to FIG. 2 in addition to FIG. 1. FIG. 2 is a schematic view showing an example structure of the excavator 100 according to the present embodiment. Note that in FIG. 2, the mechanical power system, hydraulic oil lines, pilot lines, and electrical control system are shown by double lines, solid lines, dashed lines, and dotted lines, respectively.

The drive system of the excavator 100 according to the present embodiment includes an engine 11, a regulator 13, a main pump 14, and control valves 17. Also, the hydraulic drive system of the excavator 100 according to the present embodiment includes hydraulic actuators such as, as described earlier, the drive hydraulic motors 1L and 1R, the rotating hydraulic motor 2A, the boom cylinder 7, the arm cylinder 8, and the bucket cylinder 9 that hydraulically drive the lower traveling body 1, the upper rotating body 3, the boom 4, the arm 5, and the bucket 6, respectively.

The engine 11 is the main supply of force in the hydraulic drive system and is mounted, for example, at the rear of the upper rotating body 3. To be more specific, the engine 11 rotates constantly at a preset target number of rotations per unit time under direct or indirect control by the controller 30 (described later), and drives the main pump 14 and the pilot pump 15. The engine 11 is, for example, a diesel engine that runs on light oil.

The regulator 13 controls the amount of discharge of the main pump 14. For example, the regulator 13 adjusts the angle of the slant disk of the main pump 14 in accordance with control commands from the controller 30. The regulators 13 includes, for example, regulators 13L and 13R, as will be described below.

For example, like the engine 11, the main pump 14 is attached to the rear of the upper rotating body 3 and supplies hydraulic oil to the control valves 17 through high-pressure hydraulic lines. The main pump 14 is driven by the engine 11 as described above. The main pump 14 is, for example, a variable displacement hydraulic pump. As described earlier, under the control of the controller 30, the regulator 13 adjusts the tilting angle of the slant disk to adjust the stroke length of pistons and control the amount of discharge (discharge pressure). The main pump 14 includes, for example, main pumps 14L and 14R, as will be described later.

The control valves 17 are, for example, a hydraulic control device that is mounted on the center part of the upper rotating body 3 to control the hydraulic drive system in accordance with operations that the operator performs on the operating device 26. As described above, the control valves 17 are connected to the main pump 14 via a high-pressure hydraulic line, and selectively supplies the hydraulic oil supplied from the main pump 14 to the hydraulic actuators (drive hydraulic motors 1L and 1R, rotating hydraulic motor 2A, boom cylinder 7, arm cylinder 8, and bucket cylinder 9) based on the operating state of the operating device 26. To be more specific, the control valves 17 include control valves 171 to 176 that control the flow rate and flow direction of hydraulic oil supplied from the main pump 14 to each hydraulic actuator. To be more specific, the control valve 171 corresponds to the drive hydraulic motor 1L, the control valve 172 corresponds to the drive hydraulic motor 1R, and the control valve 173 corresponds to the rotating hydraulic motor 2A. Also, the control valve 174 corresponds to the bucket cylinder 9, the control valve 175 corresponds to the boom cylinder 7, and the control valve 176 corresponds to the arm cylinder 8. Also, the control valve 175 includes, for example, control valves 175L and 175R, as will be described below, and the control valve 176 includes, for example, control valves 176L and 176R, as will be described later. The details of the control valves 171 to 176 will be described later.

The operating system of the excavator 100 according to the present embodiment includes the pilot pump 15 and the operating device 26. The operating system of the excavator 100 also includes a shuttle valve 32 as a component that relates to the machine control function of the controller 30, which will be described later.

The pilot pump 15 is mounted, for example, at the rear of the upper rotating body 3 and supplies pilot pressures to the operating device 26 via a pilot line. The pilot pump 15 is, for example, a fixed displacement hydraulic pump and is driven by the engine 11, as described earlier.

The operating device 26 is an operation input means that allows the operator to operate various operating elements (the lower traveling body 1, the upper rotating body 3, the boom 4, the arm 5, the bucket 6, etc.) and provided near the cockpit of the cabin 10. In other words, the operating device 26 is an operation input means for allowing the operator to operate the hydraulic actuators that drive the corresponding operating elements (such as the drive hydraulic motors 1L and 1R, the rotating hydraulic motor 2A, the boom cylinder 7, the arm cylinder 8, the bucket cylinder 9, etc.). The operating device 26 is connected to the control valves 17 directly through its secondary pilot line, or indirectly through the shuttle valve 32 (described later) provided on the secondary pilot line. By this means, pilot pressures mirroring how the lower traveling body 1, the upper rotating body 3, the boom 4, the arm 5, the bucket 6, and the like are controlled on the operating device 26 may be input to the control valves 17. Consequently, the control valves 17 can drive each hydraulic actuator according to its state of operation on the operating device 26. The operating device 26 includes, for example, lever devices for operating the upper rotating body 3 (rotating hydraulic motor 2A), the boom 4 (boom cylinder 7), the arm 5 (arm cylinder 8), and the bucket 6 (bucket cylinder 9). Also, the operating device 26 includes, for example, lever devices and pedal devices for operating each of the pair of left and right crawlers (drive hydraulic motors 1L and 1R) of the lower traveling body 1.

The shuttle valve 32 has two inlet ports and one outlet port, and hydraulic oil having the higher pilot pressure between the pilot pressures input to the two inlet ports is output to the outlet port. One of the two inlet ports of the shuttle valve 32 is connected to the operating device 26, and the other one is connected to the proportional valve 31. The outlet port of the shuttle valve 32 is connected to the pilot port of a corresponding control valve in the control valves 17 via a pilot line. Consequently, when the operating device 26 and the proportional valve 31 each generate a pilot pressure, the shuttle valve 32 can apply the higher pilot pressure to the pilot port of a corresponding control valve. In other words, the controller 30, which will be described later, outputs pilot pressures that are higher than the secondary pilot pressure output from the operating device 26, from the proportional valve 31. By this means, the controller 30 can control corresponding control valves, and control the operation of various operating elements, regardless of the operations that the operator performs on the operating device 26.

Note that the operating device 26 (the left operating lever, the right operating lever, the left drive lever, and the right drive lever) may be an electric device that outputs electric signals, instead of a hydraulic pilot device that outputs pilot pressures. In this case, the electric signals output from the operating device 26 are input to the controller 30, and the controller 30 controls the control valves 171 to 176 in the control valves 17 according to the electric signals received as inputs, thereby allowing various hydraulic actuators to operate based on what operations are performed on the operating device 26. For example, the control valves 171 to 176 of the control valves 17 may be electromagnetic solenoid spool valves that are driven based on commands from the controller 30. Also, for example, an electromagnetic valve that operates according to electric signals from the controller 30 may be provided between the pilot pump 15 and the pilot port of each one of the control valves 171 to 176. In this case, assuming that the electric operating device 26 is operated manually, the controller 30 then controls the corresponding electromagnetic valve to increase or decrease the pilot pressure, based on an electric signal corresponding to the amount of that operation (for example, the amount of lever operation), thereby allowing the control valves 171 to 176 to operate based on how the operating device 26 is operated.

The control system of the excavator 100 according to the present embodiment includes a controller 30, a discharge pressure sensor 28, an operation pressure sensor 29, a proportional valve 31, a display device 40, an input device 42, a sound output device 43, a storage device 47, a boom angle sensor S1, an arm angle sensor S2, a bucket angle sensor S3, a machine angle sensor S4, a rotation sensor S5, an image capturing device S6, a the positioning device Mi, and a communication device T1.

The controller 30 (an example of the control device) is provided, for example, inside the cabin 10, and drives and controls the excavator 100. The functions of the controller 30 may be implemented by any hardware, software, or combinations thereof. For example, the controller 30 is primarily formed with a microcomputer including a CPU (Central Processing Unit), ROM (Read Only Memory), RAM (Random Access Memory), a non-volatile secondary storage device, various input/output interfaces, and so forth. The controller 30 implements various functions by executing various programs stored in the ROM or a non-volatile secondary storage device, on the CPU.

For example, the controller 30 sets a target number of rotations per unit time based on the mode of operation, which is set in advance by a predetermined operation by the operator and the like, and executes drive control such that the engine 11 rotates at a constant speed.

Also, for example, the controller 30 outputs a control command to the regulator 13 if necessary, and changes the amount of discharge from the main pump 14.

Also, for example, the controller 30 executes control related to a machine guidance function to guide the operator's manual operation of the excavator 100 through the operating device 26. Also, for example, the controller 30 executes control related to a machine control function to automatically assist the operator's manual operation of the excavator 100 through the operating device 26. In other words, the controller 30 includes a machine guidance part 50 as a functional part related to the machine guidance function and the machine control function. Also, the controller 30 includes a load processing part 60, which will be described later.

Note that some of the functions of the controller 30 may be implemented by other controllers (control devices). In other words, the functions of the controller 30 may be implemented in a distributed manner by multiple controllers. For example, the machine guidance function and the machine control function may be implemented by a dedicated controller (control device).

The discharge pressure sensor 28 detects the discharge pressure of the main pump 14. A detection signal corresponding to the discharge pressure detected by the discharge pressure sensor 28 is input to the controller 30. The discharge pressure sensor 28 includes, for example, discharge pressure sensors 28L and 28R, as will be described later.

As described above, the operation pressure sensor 29 detects a secondary pilot pressure of the operating device 26, that is, a pilot pressure corresponding to the operating state (for example, the details of operation such as the direction of operation, the amount of operation, and so forth) of each given operating element (that is, hydraulic actuator) in the operating device 26. The detection signals detected by the operation pressure sensor 29 with respect to pilot pressures corresponding to the operating state of the lower traveling body 1, upper rotating body 3, boom 4, arm 5, and bucket 6 in the operating device 26 are input to the controller 30.

Note that, instead of the operation pressure sensor 29, other sensors that can detect the operating state of each operating element in the operating device 26, such as an encoder or potentiometer that can detect the amount of operation (amount of tilt) and the tilting direction of lever devices, may be provided.

The proportional valve 31 is provided in the pilot line connecting the pilot pump 15 and the shuttle valve 32, and structured such that its flow path area (cross-sectional area in which hydraulic oil can flow) can be changed. The proportional valve 31 operates according to a control command input from the controller 30. By this means, even if the operating device 26 is not being operated by the operator, the controller 30 can supply hydraulic oil discharged from the pilot pump 15 to the pilot ports of corresponding control valves in the control valves 17 via the proportional valve 31 and the shuttle valve 32.

The display device 40 is provided in a location that is readily visible to the operator seated in the cabin 10, and displays images pertaining to various information under the control of the controller 30. The display device 40 may be connected to the controller 30 via an in-vehicle communication network such as a CAN (Controller Area Network), or may be connected to the controller 30 via a one-to-one dedicated line.

The input device 42 is installed within reach of the operator seated in the cabin 10, receives various operations as inputs from the operator, and outputs signals corresponding to the operational inputs, to the controller 30. The input device 42 includes: a touch panel that is placed over the display of the display device that displays images pertaining to various information; a knob switch that is provided at the tip of the lever part of each lever device; and button switches, levers, toggles, rotary dials, etc. installed around the display device 40. Signals to match the operations performed on the input device 42 are input to the controller 30.

Also, the input device 42 has a mode switch 42*a*. The mode switch 42*a* is a switch for switching the operation mode of the excavator 100. The operation mode refers to the type of job that the excavator 100 performs, and examples include craning mode, normal mode, etc. Note that the mode switch 42*a* may be a software switch on a touch panel placed over the screen of the display device 40, may be a hardware switch installed in the vicinity of the display device 40, or may be a switch installed in another position in the cabin 10.

Also, the input device 42 has an anti-swing function switch 42*b*. The anti-swing function switch 42*b* is a switch for switching between activated mode in which the anti-swing control described below is activated, and deactivated mode in which the anti-swing control described below is deactivated. Note that the anti-swing function switch 42*b* may be a software switch on a touch panel placed over the screen of the display device 40, may be a hardware switch installed in the vicinity of the display device 40, or may be a switch installed in another position inside the cabin 10.

The sound output device 43 is provided, for example, in the cabin 10, connected to the controller 30, and outputs sound under the control of the controller 30. The sound output device 43 is, for example, a speaker or a buzzer. The sound output device 43 outputs a variety of information in sound, based on a sound output command from the controller 30.

The storage device 47 is provided, for example, in the cabin 10, and stores a variety of information under the control of the controller 30. The storage device 47 is, for example, a non-volatile storage medium such as a semiconductor memory. The storage device 47 may store information output from various devices while the excavator 100 is operating, or may store information obtained via various devices before the excavator 100 starts operating. The storage device 47 may store, for example, data about a target working surface that is obtained via a communication device T1 or that is set via the input device 42 or the like. The target working surface may be set (saved) by the operator of the excavator 100, or may be set by the construction manager, or the like.

The boom angle sensor S1 is attached to the boom 4 and detects the elevation angle (hereinafter referred to as the "boom angle") of the boom 4 relative to the upper rotating body 3, which is, for example, in a side view, the angle that the straight line connecting the fulcrums at both ends of the boom 4 forms with respect to the rotating plane of the upper rotating body 3. The boom angle sensor S1 may include, for example, a rotary encoder, an acceleration sensor, a 6-axis sensor, an IMU (Inertial Measurement Unit), etc. The boom angle sensor S1 may also include a potentiometer that uses a variable resistor, a cylinder sensor that detects the amount of stroke of the hydraulic cylinder (boom cylinder 7) that corresponds to the boom angle, etc. The same applies to the arm angle sensor S2 and bucket angle sensor S3. The detection signal corresponding to the boom angle detected by the boom angle sensor 1 is input to the controller 30.

The arm angle sensor S2 is attached to the arm 5 and detects the rotating angle (hereinafter referred to as "arm angle") of the arm 5 relative to the boom 4, which is, for example, in a side view, the angle that the straight line connecting the fulcrums at both ends of the arm 5 forms with respect to the straight line connecting the fulcrums at both ends of the boom 4. The detection signal corresponding to the arm angle detected by the arm angle sensor S2 is input to the controller 30.

The bucket angle sensor S3 is attached to the bucket 6 and detects the rotating angle (hereinafter referred to as "bucket angle") of the bucket 6 relative to the arm 5, which is, for example, in a side view, the angle that the straight line connecting the fulcrum and the tip (tooth edge) of the bucket 6 forms with respect to the straight line connecting the fulcrums at both ends of the arm 5. The detection signal corresponding to the bucket angle detected by the bucket angle sensor S3 is input to the controller 30.

The machine angle sensor S4 detects the tilting state of the machine (in this case, the upper rotating body 3 or the lower traveling body 1) relative to the horizontal plane. The machine angle sensor S4 is attached, for example, to the upper rotating body 3, and detects the tilting angles of the excavator 100 (that is, its upper rotating body 3) relative to two axes in the front-back direction and the left-right direction (hereinafter respectively referred to as the "front-back tilting angle" and the "left-right angle"). The machine angle sensor S4 may include, for example, a rotary encoder, an acceleration sensor, a 6-axis sensor, an IMU, etc. The detection signals corresponding to the tilting angles (the front-back tilting angle and the left-right tilting angle) detected by the machine angle sensor S4 are input to the controller 30.

The rotation sensor S5 outputs detection information related to the rotating state of the upper rotating body 3. The rotation sensor S5 detects, for example, the rotating angular velocity and rotating angle of the upper rotating body 3. The rotation sensor S5 may include, for example, a gyro sensor, a resolver, a rotary encoder, etc. The detection signals corresponding to the rotating angle and rotating angular velocity of the upper rotating body 3 detected by the rotation sensor S5 are input to the controller 30.

Image capturing devices S6 serves as space recognition devices and capture the images of the surroundings of the excavator 100. The image capturing devices S6 include: a camera S6F that captures images in front of the excavator 100; a camera S6L that captures images to the left of the excavator 100; a camera S6R that captures images to the right of the excavator 100; and a camera S6B that captures images behind the excavator 100.

The camera S6F is attached, for example, to the ceiling of the cabin 10, that is, inside the cabin 10. The camera S6F may also be attached to the roof of the cabin 10, a side surface of the boom 4, or outside the cabin 10. The camera S6L is attached to the left end of the upper surface of the upper rotating body 3, the camera S6R is attached to the right end of the upper surface of the upper rotating body 3, and the camera S6B is attached to the rear end of the upper surface of the upper rotating body 3.

Each of the image capturing devices S6 (cameras S6F, S6B, S6L, and S6R) is, for example, a monocular wide-angle camera with a very wide angle of view. Also, the image capturing device S6 may be a stereo camera, a depth camera, etc. The images captured by the image capturing device S6 are input to the controller 30 via the display device 40.

The image capturing devices S6, which serve as space recognition devices, may function as object detection sensors as well. In this case, the image capturing device S6 may detect objects present around the excavator 100. The objects to be detected may include, for example, people, animals, vehicles, construction machines, buildings, holes, etc. Also, any given image capturing device S6 may calculate the distance from the image capturing device S6 or the excavator 100 to an identified object. The image capturing devices S6 to serve as object detection sensors may include, for example, a stereo camera, a depth sensor, etc. The space recognition devices may include, for example, a monocular camera which has an image capturing element such as a CCD or CMOS, and which outputs captured images to the display device 40. Also, the space recognition devices may be structured such that any given space recognition device may calculate the distance from the space recognition device or the excavator 100 to an identified object. In addition to the image capturing devices S6, other object detection sensors such as an ultrasonic sensor, a millimeter wave radar, a LIDAR, and an infrared sensor may be provided as space recognition devices. When a millimeter wave radar, an ultrasonic sensor, a laser radar, or the like is used as a space recognition device 80, multiple signals (laser beams, for example) may be transmitted to an object, and, by receiving the reflected signals, the distance and direction of the object may be detected from the reflected signals.

Note that image capturing devices S6 may be directly communicably connected to the controller 30.

A boom-rod pressure sensor S7R and a boom-bottom pressure sensor S7B are attached to the boom cylinder 7. An arm-rod pressure sensor S8R and an arm-bottom pressure sensor S8B are attached to the arm cylinder 8. A bucket-rod pressure sensor S9R and a bucket-bottom pressure sensor S9B are attached to the bucket cylinder 9. The boom-rod pressure sensor S7R, boom-bottom pressure sensor S7B, arm-rod pressure sensor S8R, arm-bottom pressure sensor S8B, bucket-rod pressure sensor S9R, and bucket-bottom pressure sensor S9B are collectively referred to as "cylinder pressure sensors."

The boom-rod pressure sensor S7R detects the pressure in the rod-side oil chamber of the boom cylinder 7 (hereinafter referred to as "boom-rod pressure"), and the boom-bottom pressure sensor S7B detects the pressure in the bottom-side oil chamber of the boom cylinder 7 (hereinafter referred to as "boom-bottom pressure"). The arm-rod pressure sensor S8R detects the pressure in the rod-side oil chamber of the arm cylinder 8 (hereinafter referred to as "arm-rod pressure"), and the arm-bottom pressure sensor S8B detects the pressure in the bottom-side oil chamber of the arm cylinder 8 (hereinafter referred to as "arm-bottom pressure"). The bucket-rod pressure sensor S9R detects the pressure in the rod-side oil chamber of the bucket cylinder 9 (hereafter referred to as "bucket-rod pressure"), and the bucket-bottom pressure sensor S9B detects the pressure in the bottom-side oil chamber of the bucket cylinder 9 (hereafter referred to as "bucket-bottom pressure").

The positioning device Ml measures the position and orientation of the upper rotating body 3. The positioning device Ml is, for example, a GNSS (Global Navigation Satellite System) compass for detecting the position and orientation of the upper rotating body 3, and detection signals corresponding to the position and orientation of the upper rotating body 3 are input to the controller 30. In addition, the function of the positioning device Ml to detect the orientation of the upper rotating body 3 may be replaced by a compass sensor attached to the upper rotating body 3.

The communication device T1 communicates with external devices through a predetermined network such as a mobile communication network in which a base station is an end, a satellite communication network, the Internet, etc. The communication device T1 is, for example, a mobile communication module compatible with mobile communication standards such as LTE (Long Term Evolution), 4G (4th Generation), and 5G (5th Generation), or a satellite communication module for connecting with a satellite communication network.

The machine guidance part 50 controls, for example, the machine guidance function of the excavator 100. The machine guidance part 50 tells job information, such as the distance between the target working surface and the tip of the attachment (to be more specific, the working part of the end attachment), to the operator, via the display device 40 and the sound output device 43. Data about the target working surface is stored in advance in the storage device 47, for example, as described above. Data about the target working surface is expressed, for example, in a reference coordinate system. The reference coordinate system is, for example, the world geodetic system. The world geodetic system is a three-dimensional orthogonal XYZ coordinate system, in which the center of gravity of the Earth is the origin, with the X-axis pointing toward the intersection of the Greenwich meridian and the equator, the Y-axis pointing toward 90 degrees east longitude, and the Z-axis pointing toward the north pole. For example, the operator may set an arbitrary point in the work site as a point of reference, and, using the input device 72, sets a target working surface based on the relative positional relationship with respect to the reference point. The working part of the bucket 6 is, for example, the teeth of the bucket 6, the back surface of the bucket 6, and so forth. Also, if a breaker is used as the end attachment instead of the bucket 6, the breaker's tip serves as the working part. By this means, the machine guidance part 50 can report job information to the operator through the display device 40, sound output device 43, and the like, and guide the operator in operating the excavator 100 through the operating device 26.

Also, the machine guidance part 50 controls, for example, the machine control function of the excavator 100. The machine guidance part 50 may automatically operate at least one of the boom 4, the arm 5, and the bucket 6, for example, while the operator is manually performing an excavation operation, such that the target working surface and the tip position of the bucket 6 meet each other.

The machine guidance part 50 acquires information from the boom angle sensor S1, arm angle sensor S2, bucket angle sensor S3, machine angle sensor S4, rotation sensor S5, image capturing device S6, positioning device Mi, communication device T1, input device 42, etc. The machine guidance part 50 then calculates the distance between the bucket 6 and the target working surface based on the acquired information, notifies the operator of the magnitude of the distance between the bucket 6 and the target working surface by outputting sound from the sound output device 43, displaying images on the display device 40, and so on, automatically controls the operation of the attachment such that the tip of the attachment (to be more specific, the working part such as the teeth or the back surface of the bucket 6) meets the target working surface. The machine guidance part 50 includes a position calculation part 51, a distance calculation part 52, an information communicating part 53, an automatic control part 54, a rotating angle calculation part 55, and a relative angle calculation part 56 as functional components related to the machine guidance function and the machine control function.

The position calculation part 51 calculates the position of a predetermined positioning target. For example, the position calculation part 51 calculates the coordinates of the working part such as the tip of the attachment, to be more specific, the teeth or the back surface of the bucket 6, in the reference coordinate system. To be more specific, the position calculation part 51 calculates the coordinates of the working part of the bucket 6, from the respective elevation angles of the boom 4, the arm 5, and the bucket 6 (the boom angle, the arm angle, and the bucket angle).

The distance calculation part 52 calculates the distance between two positioning targets. For example, the distance calculation part 52 calculates the distance between the working part of the attachment, such as the teeth or the back surface of the bucket 6, and the target working surface. The distance calculation part 52 may also calculate the angle (relative angle) between the back surface of the bucket 6 serving as the working part and the target working surface.

The information communicating part 53 transmits (notifies) a variety of information to the operator of the excavator 100 through a predetermined notification means such as the display device 40 or the sound output device 43. The information communicating part 53 notifies the operator of the excavator 100 of the magnitude (degree) of the distance and the like calculated by the distance calculation part 52. For example, the information communicating part 53 notifies the operator of the distance (its magnitude) between the tip of the bucket 6 and the target working surface by using at least one of visual information output from the display device 40 and auditory information output from the sound output device 43. The information communicating part 53 may also notify the operator of the relative angle (its magnitude) between the back surface of the bucket 6 serving as the working part and the target working surface using at least one of visual information from the display device 40 and auditory information from the sound output device 43.

To be more specific, the information communicating part 53 outputs intermittent sounds from the sound output device 43 to tell the distance (for example, the vertical distance) between the working part of the bucket 6 and the target working surface to the operator. In this case, the information communicating part 53 may shorten the interval of intermittent sounds as the vertical distance decreases, and lengthen the interval of intermittent sounds as the vertical distance increases. Also, the information communicating part 53 may use a continuous sound, or may express the difference in the vertical distance by changing the pitch, strength, and the like of the sound. Also, the information communicating part 53 may issue an alarm through the sound output device 43 when the tip of the bucket 6 is positioned lower than the target working surface, that is, when the tip of the bucket 6 passes the target working surface. The alarm is, for example, a continuous sound that is significantly louder than the intermittent sound.

Also, the information communicating part 53 may display, as job information, on the display device 40, the distance between the tip of the attachment (to be more specific, the working part of the bucket 6) and the target working surface, the relative angle between the back surface of the bucket 6 and the target working surface, etc. Under the control of the controller 30, the display device 40 displays, for example, the job information received from the information communicating part 53 together with the image data received from the image capturing devices S6. The information communicating part 53 may tell the vertical distance to the operator, for example, by showing an image of an analog meter or a bar graph indicator.

The automatic control part 54 operates the actuators automatically, thereby automatically assisting the operator in manual operation of the excavator 100 through the operating device 26. To be more specific, the automatic control part 54 can individually and automatically adjust the respective pilot pressures that act on control valves (to be more specific, the control valve 173, the control valves 175L and 175R, and the control valve 174) corresponding to multiple hydraulic actuators (to be more specific, the rotating hydraulic motor 2A, the boom cylinder 7, and the bucket cylinder 9), as will be described later. By this means, the automatic control part 54 can automatically operate each hydraulic actuator. The automatic control part 54 may exert control over the machine control function when, for example, a predetermined switch included in the input device 42 is pressed. The predetermined switch may be, for example, a machine control switch (hereinafter referred to as "MC (Machine Control) switch"), which may be attached, to the tip of the operating device 26, as a knob switch to be gripped by the operator (for example, a lever device for operating the arm 5). The following explanation will be given on the assumption that when the MC switch is pressed, the machine control function is active.

For example, when the MC switch or the like is pressed, the automatic control part 54 automatically extends and retracts at least one of the boom cylinder 7 and the bucket cylinder 9, in accordance with the operation of the arm cylinder 8, in order to assist excavation or shaping. To be more specific, when the operator manually performs an operation to fold the arm 5 (hereinafter referred to as "arm-folding operation"), the automatic control part 54 automatically extends and retracts at least one of the boom cylinder 7 and the bucket cylinder 9 such that the target working surface and the position of the working part such as the teeth or the back surface of the bucket 6 meet. In this case, the operator can fold the arm 5 while controlling the teeth of the bucket 6 to meet the target working surface simply by performing an arm-folding operation on a lever device for operating the arm 5.

Also, when the MC switch or the like is pressed, the automatic control part 54 may automatically rotate the rotating hydraulic motor 2A such that the upper rotating body 3 faces the target working surface directly (an example of an actuator). Hereinafter, the control by the controller 30 (automatic control part 54) for making the upper rotating body 3 directly face the target working surface will be referred to as "face-to-face control." By this means, the operator or the like can make the upper rotating body 3 face the target working surface directly simply by pressing a predetermined switch or by operating a lever device (rotating operation lever) for rotating operations while the switch is pressed. Also, the operator can make the upper rotating body 3 directly face the target working surface, and, furthermore, start the above-described machine control function related to excavation of the target working surface, simply by pressing the MC switch.

For example, in the state in which the upper rotating body 3 of the excavator 100 faces the target working surface directly, the tip of the attachment (for example, the teeth or the back surface of the bucket 6 as the working part) can be moved in the direction in which the target working surface (upward slope) is tilted, according to the movement of the attachment. To be more specific, in the state in which the upper rotating body 3 of the excavator 100 faces the target working surface directly, the working surface of the attachment of the excavator 100 that is perpendicular to the working plane (the attachment's moving range) of the excavator 100 includes the normal (is along the normal, in other words) of a cylindrical target working surface.

If the attachment's moving range of the excavator 100 does not include the normal of the cylindrical target working surface, the tip of the attachment cannot move the target working surface in a tilting direction. As a result of this, the excavator 100 cannot properly work the target working surface. By contrast with this, however, the automatic control part 54 can automatically rotate the rotating hydraulic motor 2A and make the upper rotating body 3 face the target working surface directly. By this means, the excavator 100 can properly work the target working surface.

In face-to-face control, for example, when the left-end vertical distance between the coordinate of the left end of the teeth of the bucket 6 and the target working surface (hereinafter simply "left-end vertical distance") becomes equal to the right-end vertical distance between the coordinate of the right end of the teeth of the bucket 6 and the target working surface (hereinafter simply "right-end vertical distance"), the automatic control part 54 determines that the excavator 100 is directly facing the target working surface. Also, the automatic control part 54 may determine that the excavator 100 is directly facing the target working surface, not when the left-end vertical distance and the right-end vertical distance are equal (that is, when the difference between the left-end vertical distance and the right-end vertical distance is zero), but when the difference between the distances is less than or equal to a predetermined value.

Also, in face-to-face control, the automatic control part 54 may operate the rotating hydraulic motor 2A based on, for example, the difference between the left-end vertical distance and the right-end vertical distance. To be more specific, when the rotating operation lever is operated while a predetermined switch such as an MC switch is pressed, the automatic control part 54 determines whether the lever device is operated in a direction to make the upper rotating body 3 face the target working surface directly. For example, when the lever device is operated in a direction to increase the vertical distance between the teeth of the bucket 6 and the target working surface (upward slope), the automatic control part 54 does not execute face-to-face control. On the other hand, when the rotating operation lever is operated in a direction to decrease the vertical distance between the teeth of the bucket 6 and the target working surface (upward slope), the automatic control part 54 executes face-to-face control. As a result of this, the automatic control part 54 can operate the rotating hydraulic motor 2A such that the difference between the left-end vertical distance and the right-end vertical distance becomes smaller. Subsequently, when the difference is less than or equal to a predetermined value or is zero, the automatic control part 54 stops the rotating hydraulic motor 2A. Also, the automatic control part 54 may set the rotating angle, at which the difference the left-end vertical distance and the right-end vertical distance is less than or equal to a predetermined value or is zero as a target angle, and control the operation of the rotating hydraulic motor 2A such that the difference between the target angle and the current rotating angle (to be more specific, the value of the detection signal from the rotation sensor S5) becomes zero. In this case, the rotating angle is, for example, the angle of the front-back axis of the upper rotating body 3 relative to the reference direction.

Note that, as described above, when a rotating electric motor is installed in the excavator 100 instead of the rotating hydraulic motor 2A, the automatic control part 54 performs face-to-face control on the rotating electric motor (an example of an actuator) as the control object.

The rotating angle calculation part 55 calculates the rotating angle of the upper rotating body 3. By this means, the controller 30 can identify the current orientation of the upper rotating body 3. The rotating angle calculation part 55 calculates the angle of the front-back axis of the upper rotating body 3 relative to the reference direction as the rotating angle based on, for example, the output signal of a GNSS compass included in the positioning device Ml. The rotating angle calculation part 55 may also calculate the rotating angle based on the detection signal of the rotation sensor S5. Also, when a reference point is set at the work site, the rotating angle calculation part 55 may set the direction of the reference point viewed from the rotating axis as the reference direction.

The rotating angle indicates the direction in which the attachment's moving range extends relative to the reference direction. The attachment's moving range is, for example, a virtual plane that, cutting the attachment vertically, is arranged so as to be perpendicular to the rotating plane. The rotating plane is, for example, a virtual plane including the bottom surface of a rotating frame that is perpendicular to a rotating axis. For example, when the controller 30 determines that the attachment's moving range includes the normal of the target working surface, the controller 30 also determines that the upper rotating body 3 faces the target working surface directly (machine guidance part 50).

The relative angle calculation part 56 calculates the rotating angle (relative angle) that is needed to make the upper rotating body 3 face the target working surface directly. The relative angle here refers to, for example, the relative angle that is formed between the direction of the front-back axis of the upper rotating body 3 when the upper rotating body 3 faces the target working surface directly and the current direction of the front-back axis of the upper rotating body 3. The relative angle calculation part 56 calculates the relative angle based on, for example, data about the target working surface stored in the storage device 47 and the rotating angle calculated by the rotating angle calculation part 55.

When the rotating operation lever is operated while a predetermined switch such as an MC switch is pressed, the automatic control part 54 determines whether a rotating operation has been performed in the direction to make the upper rotating body 3 directly face the target working surface. If the automatic control part 54 determines that a rotating operation has been performed in the direction to make the upper rotating body 3 face the target working surface directly, the automatic control part 54 sets the relative angle calculated by the relative angle calculation part 56 as the target angle. Then, if the rotating angle changes after the rotating operation lever is operated and reaches the target angle, the automatic control part 54 may determine that the upper rotating body 3 is directly facing the target working surface and stop the movement of the rotating hydraulic motor 2A. By this means, assuming the structure shown in FIG. 2, the automatic control part 54 can make the upper rotating body 3 face the target working surface directly. The above embodiment employing face-to-face control has shown an example in which face-to-face control is executed for the target working surface, but this is by no means a limitation. For example, when scooping up earth and sand that are stored on a temporary basis for later loading in a dump truck, a target excavation path to match the target volume may be generated, and a rotating operation may be carried out based on face-to-face control such that the attachment follows the target excavation path. In this case, the target excavation path is changed every time a scooping operation is performed. That is, every time earth and sand are unloaded onto the dump truck, face-to-face control is applied to the newly generated target excavation path.

Also, the rotating hydraulic motor 2A has a first port 2A1 and a second port 2A2. A hydraulic pressure sensor 21 detects the hydraulic oil's pressure at the first port 2A1 of the rotating hydraulic motor 2A. A hydraulic pressure sensor 22 detects the hydraulic oil's pressure at the second port 2A2 of the rotating hydraulic motor 2A. Detection signals corresponding to the discharge pressures detected by hydraulic pressure sensors 21 and 22 are input to the controller 30.

Also, the first port 2A1 is connected to a hydraulic oil tank via a relief valve 23. The relief valve 23 opens up when the pressure on the first port 2A1 side reaches a predetermined relief pressure, so that the hydraulic oil on the first port 2A1 side is exhausted to the hydraulic oil tank. Similarly, the second port 2A2 is connected to the hydraulic oil tank via a relief valve 24. The relief valve 24 opens up when the pressure on the second port 2A2 side reaches a predetermined relief pressure, so that the hydraulic oil on the second port 2A2 side is exhausted to the hydraulic oil tank.

Also, the first port 2A1 and the second port 2A2 are connected via a switch valve 25. The switch valve 25 is a proportional valve that is controlled to open and close in accordance with electric signals from the controller 30. When the switch valve 25 opens, the first port 2A1 and the second port 2A2 are connected. By this means, hydraulic oil can flow from the first port 2A1 to the second port 2A2, and, conversely, hydraulic oil can flow from the second port 2A2 to the first port 2A1. The aperture of the switch valve 25 is controlled in accordance with electric signals received as inputs, and adjusts the flow rate of hydraulic oil between the first port 2A1 and the second port 2A2.

[Excavator Hydraulic System]

Figure 3:
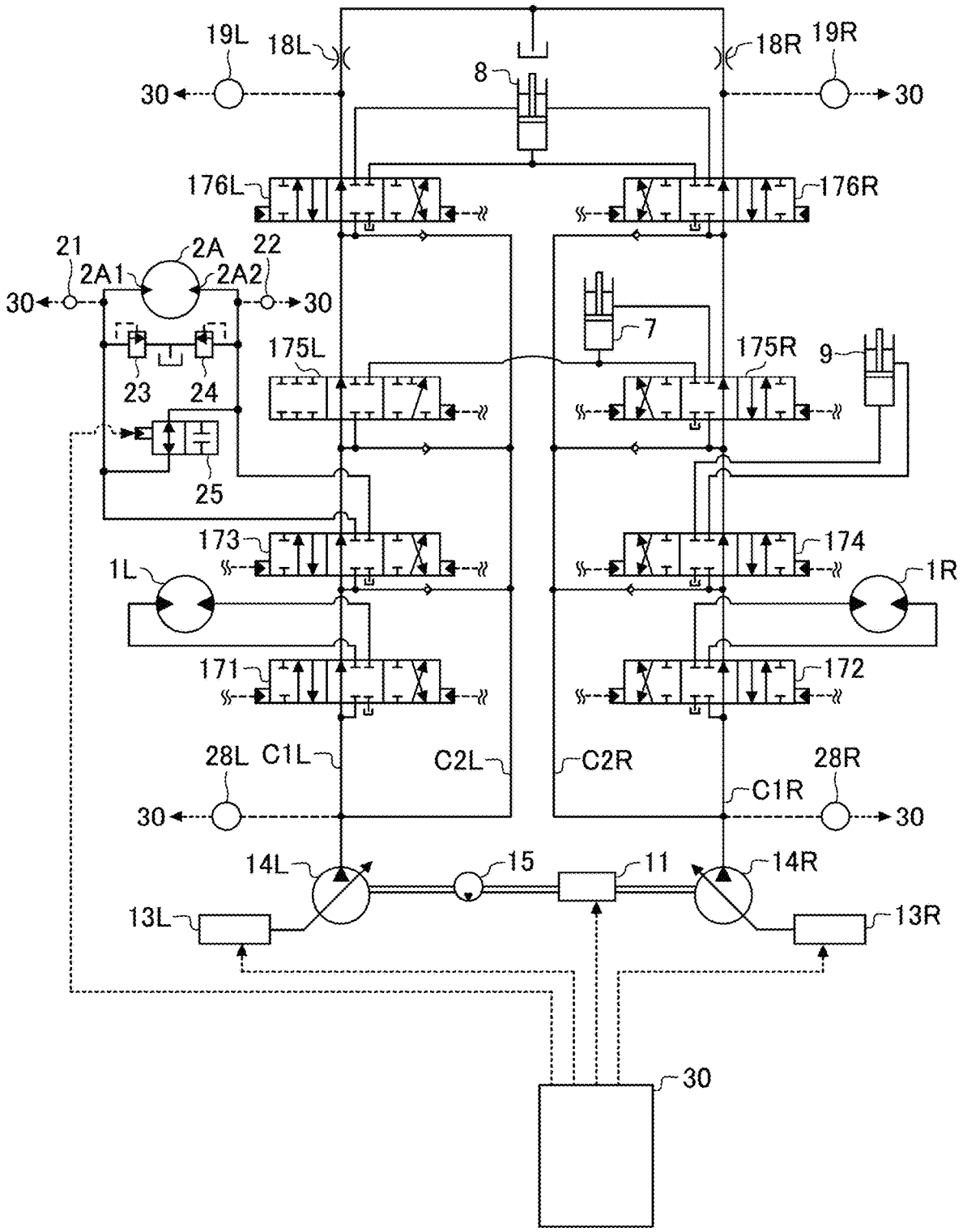
FIG. 3 is a diagram showing a first example of a hydraulic system of an excavator.

Next, referring to FIG. 3, a first example of the hydraulic system of the excavator 100 according to the present embodiment will be described. FIG. 3 is a schematic view of the first example of the hydraulic system of the excavator 100 according to the present embodiment. Note that in FIG. 3, the mechanical power system, hydraulic oil lines, pilot lines, and the electrical control system are indicated by double lines, solid lines, dashed lines, and dotted lines, respectively, as in FIG. 2 and other figures.

The hydraulic system implemented by this hydraulic circuit circulates hydraulic oil from each of the main pumps 14L and 14R driven by the engine 11, through the center bypass pipelines C1L and C1R and the parallel pipelines C2L and C2R, to a hydraulic oil tank.

The center bypass pipeline C1L starts from the main pump 14L, passes through the control valves 171, 173, 175L, and 176L located inside the control valve 17, in order, before reaching the hydraulic oil tank.

The center bypass pipeline C1R starts from the main pump 14R, passes through control valves 172, 174, 175R, and 176R located inside the control valve 17, in order, before reaching the hydraulic oil tank.

A control valve 171 is a spool valve that supplies the hydraulic oil discharged from the main pump 14L to the drive hydraulic motors 1L and exhausts the hydraulic oil discharged from the drive hydraulic motor 1L to the hydraulic oil tank.

The control valve 172 is a spool valve that supplies the hydraulic oil discharged from the main pump 14R to the drive hydraulic motors 1R and exhausts the hydraulic oil discharged from the drive hydraulic motor 1R to the hydraulic oil tank.

The control valve 173 is a spool valve that supplies the hydraulic oil discharged from the main pump 14L to the rotating hydraulic motor 2A and exhausts the hydraulic oil discharged from the rotating hydraulic motor 2A to the hydraulic oil tank.

The control valve 174 is a spool valve that supplies the hydraulic oil discharged from the main pump 14R to the bucket cylinder 9 and exhausts the hydraulic oil in the bucket cylinder 9 to the hydraulic oil tank.

The control valves 175L and 175R are spool valves that supply the hydraulic oil discharged from the main pumps 14L and 14R to the boom cylinder 7 and exhaust the hydraulic oil in the boom cylinder 7 to the hydraulic oil tank.

Control valves 176L and 176R supply the hydraulic oil discharged from the main pumps 14L and 14R to the arm cylinder 8 and exhaust the hydraulic oil in the arm cylinder 8 to the hydraulic oil tank.

The control valves 171, 172, 173, 174, 175L, 175R, 176L, and 176R adjust the rate of flow, the direction of flow, and so forth of hydraulic oil supplied to and discharged from the hydraulic actuators depending on the pilot pressure acting on each pilot port.

The parallel pipeline C2L supplies hydraulic oil from the main pump 14L to the control valves 171, 173, 175L, and 176L in parallel with the center bypass pipeline C1L. To be more specific, the parallel pipeline C2L branches off from the center bypass pipeline C1L upstream of the control valve 171, and is structured such that it can supply hydraulic oil from the main pump 14L to each of the control valves 171, 173, 175L, and 176R in parallel. By this means, the parallel pipeline C2L can supply hydraulic oil to downstream control valves when the flow of hydraulic oil through the center bypass pipeline C1L is impeded or blocked by any of the control valves 171, 173, and 175L.

The parallel pipeline C2R supplies hydraulic oil from the main pump 14R to the control valves 172, 174, 175R, and 176R in parallel with the center bypass pipeline C1R. To be more specific, the parallel pipeline C2R branches off from the center bypass pipeline C1R upstream of the control valve 172, and is structured such that it can supply hydraulic oil from the main pump 14R to each of the control valves 172, 174, 175R, and 176R in parallel. The parallel pipeline C2R can supply hydraulic oil to downstream control valves when the flow of hydraulic oil through the center bypass pipeline C1R is impeded or blocked by any of the control valves 172, 174, or 175R.

Under the control of the controller 30, the regulators 13L and 13R adjust the tilting angle of the slant disk of the main pumps 14L and 14R, thereby adjusting the amount of discharge from the main pumps 14L and 14R.

The discharge pressure sensor 28L detects the discharge pressure of the main pump 14L, and the detection signal corresponding to the detected discharge pressure is input to the controller 30. The same is true for the discharge pressure sensor 28R. By this means, the controller 30 can control the regulators 13L and 13R based on the discharge pressures of the main pumps 14L and 14R.

In the center bypass pipelines C1L and C1R, negative control throttles 18L and 18R (hereinafter referred to as "negative control throttles") are provided between the hydraulic oil tank and the most downstream control valves 176L and 176R. By this means, the flow of hydraulic oil discharged from the main pumps 14L and 14R is impeded by the negative control throttles 18L and 18R. The negative control throttles 18L and 18R then generate control pressures (hereinafter referred to as "negative control pressures") to control the regulators 13L and 13R.

The negative control pressure sensors 19L and 19R detect the negative control pressures, and detection signals corresponding to the detected negative control pressures are input to the controller 30.

The controller 30 may control the regulators 13L and 13R based on the discharge pressures of the main pumps 14L and 14R detected by the discharge pressure sensors 28L and 28R, and adjust the amount of discharge from the main pumps 14L and 14R. For example, the controller 30 may control the regulator 13L in response to an increase in the discharge pressure of the main pump 14L, and reduce the amount of discharge of the main pump 14L by adjusting the slant disk tilting angle of the main pump 14L. The same applies to the regulator 13R. By this means, the controller 30 can control the total horsepower of the main pumps 14L and 14R such that the absorbed horsepower of the main pumps 14L and 14R, which is represented by the product of the discharge pressure and the amount of discharge, does not exceed the output horsepower of the engine 11.

Also, the controller 30 may adjust the amount of discharge of the main pumps 14L and 14R by controlling the regulators 13L and 13R according to the negative control pressures detected by the negative control pressure sensors 19L and 19R. For example, the controller 30 decreases the amount of discharge of the main pumps 14L and 14R as the negative control pressure increases, and increases the amount of discharge of the main pumps 14L and 14R as the negative control pressure decreases.

To be more specific, in idle mode (the state shown in FIG. 3) in which none of the hydraulic actuators of the excavator 100 is operated, the hydraulic oil discharged from the main pumps 14L and 14R passes through the center bypass pipelines C1L and C1R to the negative control throttles 18L and 18R. Then, the flow of hydraulic oil discharged from the main pumps 14L and 14R increases the negative control pressure generated upstream of the negative control throttles 18L and 18R. As a result of this, the controller 30 reduces the amount of discharge of the main pumps 14L and 14R to the minimum allowable amount of discharge, and prevents or substantially prevents pumping loss from being produced when the discharged hydraulic oil passes in the center bypass pipelines C1L and C1R.

On the other hand, when any of the hydraulic actuators is operated through the operating device 26, the hydraulic oil discharged from the main pumps 14L and 14R flows into the hydraulic actuator to be operated, via the control valve corresponding to the hydraulic actuator to be operated. Then, the flow of hydraulic oil discharged from the main pumps 14L and 14R reduces or eliminates the amount of hydraulic oil to reach the negative control throttles 18L and 18R, lowering the negative control pressures generated upstream of the negative control throttles 18L and 18R. As a result of this, the controller 30 can increase the amount of discharge of the main pumps 14L and 14R, circulate sufficient hydraulic oil to the hydraulic actuator to be operated, and reliably driving the hydraulic actuator to be operated.

Figure 4:
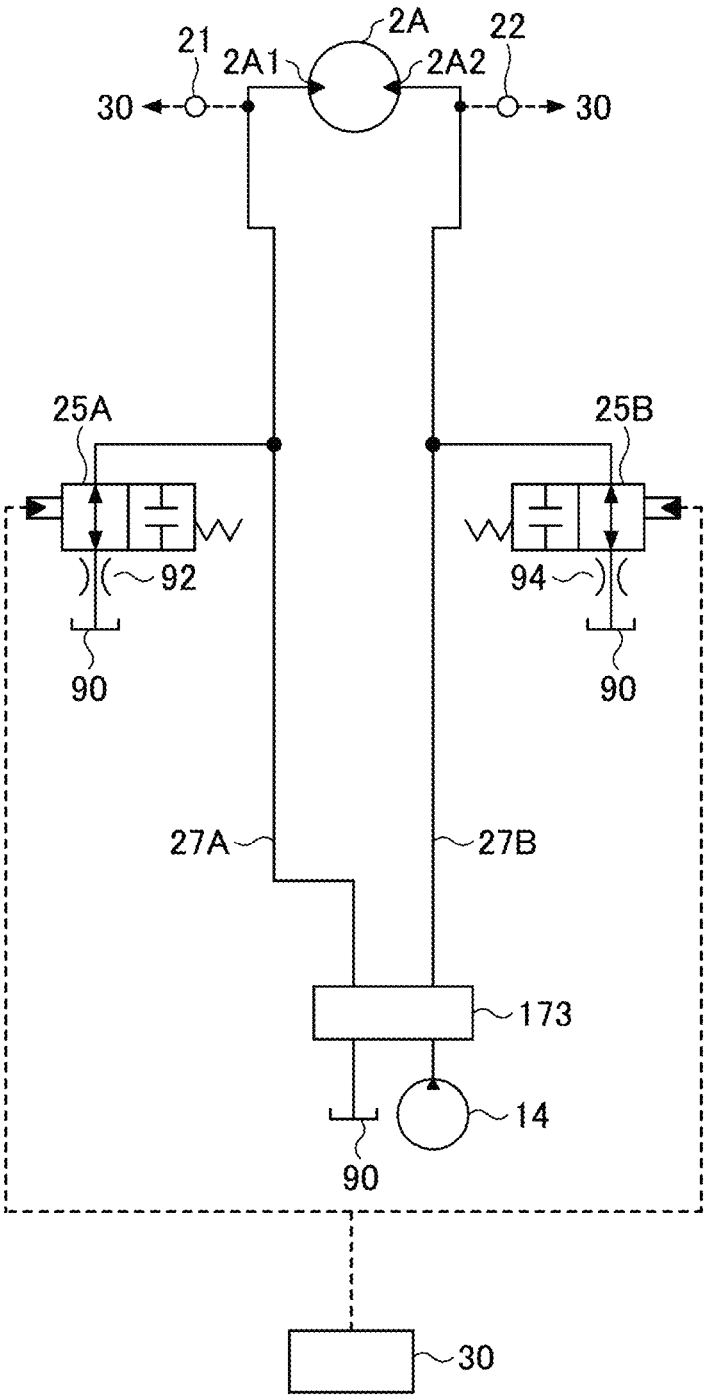
FIG. 4 is a diagram showing a second example of a hydraulic system of an excavator.

Next, a second example of the hydraulic system of the excavator 100 according to the present embodiment will be described with reference to FIG. 4. FIG. 4 is a schematic view of the second example of the hydraulic system of the excavator 100 according to the present embodiment.

The hydraulic system shown in FIG. 4 includes two switch valves 25A and 25B instead of the switch valve 25. Note that, although the relief valves 23 and 24 are not provided in the hydraulic system shown in FIG. 4, the relief valves 23 and 24 may be provided as in the hydraulic system shown in FIG. 3.

The switch valve 25A is provided between the hydraulic pressure line 27A and the hydraulic oil tank 90. The hydraulic pressure line 27A connects the control valve 173 and the first port 2A1. The switch valve 25A is a proportional valve that is controlled to open and close in accordance with electric signals from the controller 30. When the switch valve 25A opens, the first port 2A1 and the hydraulic oil tank 90 are connected. By this means, hydraulic oil can be exhausted from the first port 2A1 to the hydraulic oil tank 90, and, conversely, hydraulic oil can be supplied from the hydraulic oil tank 90 to the first port 2A1. The aperture of the switch valve 25A is controlled based on an electric signal received as input, thereby adjusting the flow rate of hydraulic oil between the first port 2A1 and the hydraulic oil tank 90.

A throttle 92 is provided between the switch valve 25A and the hydraulic oil tank 90. The speed at which hydraulic oil moves between the first port 2A1 and the second port 2A2 of the rotating hydraulic motor 2A can be adjusted by adjusting the amount of hydraulic oil that flows from the hydraulic oil tank 90 to the first port 2A1 or the amount of hydraulic oil that flows into the hydraulic oil tank 90 by using the throttle 92. As a result of this, the speed at which the upper rotating body 3 rotates is adjusted.

The switch valve 25B is provided between the hydraulic pressure line 27B and the hydraulic oil tank 90. The hydraulic pressure line 27B connects the control valve 173 and the second port 2A2. The switch valve 25B is a proportional valve that is controlled to open and close in accordance with electric signals from the controller 30. When the switch valve 25 opens, the second port 2A2 and the hydraulic oil tank 90 are connected. By this means, hydraulic oil can be exhausted from the second port 2A2 to the hydraulic oil tank 90, and, conversely, hydraulic oil can be supplied from the hydraulic oil tank 90 to the second port 2A2. The aperture of the switch valve 25B is controlled based on an electric signal received as input, thereby adjusting the flow rate of hydraulic oil between the second port 2A2 and the hydraulic oil tank 90.

A throttle 94 is provided between the switch valve 25B and the hydraulic oil tank 90. The throttle 94 has the same function as that of the throttle 92. Insofar as one of the throttle 92 and the throttle 94 is provided, the speed at which the upper rotating body 3 rotates can be adjusted. Also, the throttle 92 and the throttle 94 do not have to be provided.

Figure 5:
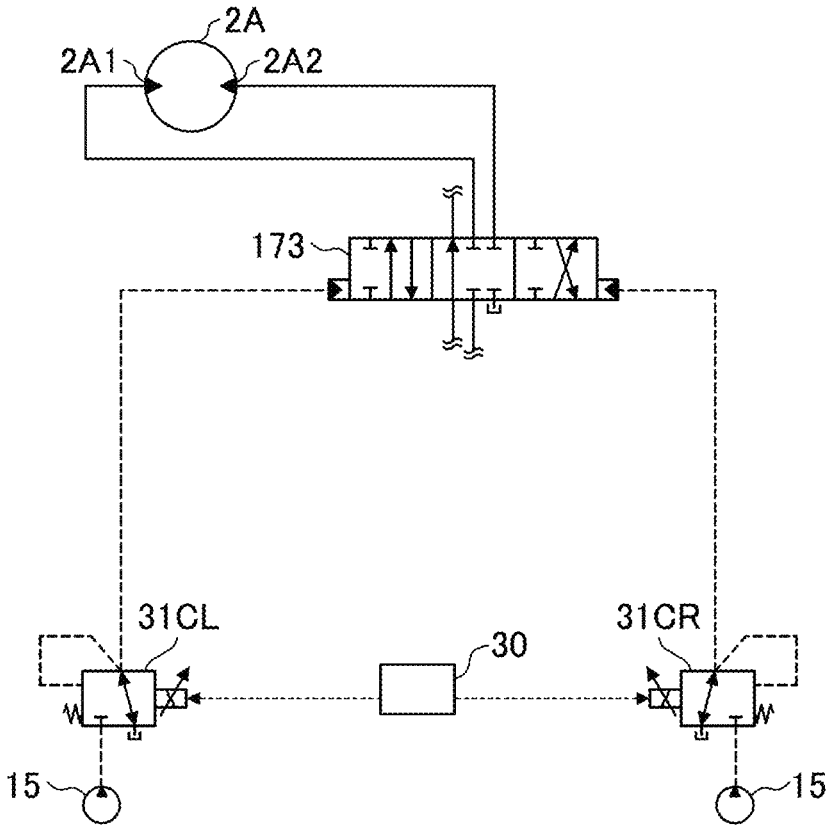
FIG. 5 is a diagram showing a third example of a hydraulic system of an excavator.

Next, a third example of the hydraulic system of the excavator 100 according to the present embodiment will be described with reference to FIG. 5. FIG. 5 is a schematic view of the third example of the hydraulic system of the excavator 100 according to the present embodiment, and is a schematic view of components related to the operating system of the hydraulic system of the excavator 100. To be more specific, FIG. 5 shows a pilot circuit that applies a pilot pressure to the control valve 173 that controls the rotating hydraulic motor 2A hydraulically.

The hydraulic system shown in FIG. 5 does not have the relief valves 23 and 24, but the relief valves 23 and 24 may be provided as in the hydraulic system shown in FIG. 3.

A proportional valve 31CL operates according to a control current received as an input from the controller 30. To be more specific, using the hydraulic oil discharged from pilot pump 15, the proportional valve 31CL outputs a pilot pressure to match the control current input from the controller 30, to the left pilot port of the control valve 173. By this means, the proportional valve 31CL can adjust the pilot pressure that acts on the left pilot port of the control valve 173.

A proportional valve 31CR operates according to a control current received as an input from the controller 30. To be more specific, using the hydraulic oil discharged from the pilot pump 15, the proportional valve 31CR outputs a pilot pressure to match the control current input from the controller 30, to the right pilot port of the control valve 173. By this means, the proportional valve 31CR can adjust the pilot pressure that acts on the right pilot port of the control valve 173.

In other words, the proportional valves 31CL and 31CR can adjust the pilot pressures to be output to the secondary side such that the control valve 173 can be stopped at any valve position regardless of how the rotating operation lever is operated.

[Anti-Swing Control]

The excavator 100 according to the present embodiment has, as its mode of operation, craning mode, in which load is hoisted by a hook 6*e*.

For example, the operator operates the mode switch 42*a* to switch to craning mode. In craning mode, the number of rotations of the engine 11 per unit time is set to a predetermined number of rotations per unit time. To be more specific, in craning mode, the number of rotations of the engine 11 per unit time is set lower than the number of rotations of the engine 11 per unit time in normal mode in which excavation is performed. Also, the opening operation of the bucket 6 is impeded.

In craning mode, when decelerating the rotation of the upper rotating body 3, if the load is positioned ahead of the hook in the rotating direction 6*e*, the controller 30 applies anti-swing control to the rotation of the rotating body to rotate the upper rotating body 3 such that the hook 6*e* is positioned immediately above the center of gravity of the load. The controller 30 applies anti-swing control to the rotation of the rotating body when, for example, the rotating operation lever is in a neutral position. However, the controller 30 may perform anti-swing control regardless of the position of the rotating operation lever as well.

By operating the anti-swing function switch 42*b*, the operator can switch between activated mode, in which the controller 30 enables anti-swing control, and deactivated mode, in which the controller 30 disables anti-swing control. In other words, when activated mode is selected, anti-swing control by the controller 30 is allowed, and, when deactivated mode is selected, anti-swing control by the controller 30 is not executed.

For example, in the event the excavator 100 is equipped with the hydraulic system shown in FIG. 3, when the controller 30 decelerates the rotation of the upper rotating body 3, the controller 30 controls the aperture of the switch valve 25 to a predetermined aperture greater than 0%. When the rotation is decelerated thus, the pressure of the rotating hydraulic motor 2A at the discharge end is higher than that at the supply end. Consequently, when the switch valve 25 opens, hydraulic oil continues being supplied from the discharge end to the supply end of the rotating hydraulic motor 2A via the switch valve 25. By this means, the upper rotating body 3 continues rotating, and the hook 6*e* moves in the direction to approach the position immediately above the load's center of gravity. Note that the predetermined aperture is, for example, less than 100%. In other words, the controller 30 controls the rotating mechanism 2 so as to prevent the rotating mechanism 2 from stopping rotating completely in response to external forces.

The predetermined aperture is determined, for example, based on information about the movement of the load (hereinafter referred to as "swing information"). The swing information may be, for example, the rotational moment about the rotating axis of the upper rotating body 3. The rotational moment can be calculated from the load's weight calculated by the method of calculating weight of the load weight, which will be described later, and the radius of rotation of the attachment. The swing information may also be, for example, information about the load as recognized by the space recognition device, the load's position detected by a positioning device such as a GNSS compass attached to the load, the pressures of hydraulic oil at the first port 2A1 and the second port 2A2 of the rotating hydraulic motor 2A detected by the hydraulic pressure sensors 21 and 22.

The controller 30 closes the switch valve 25 when the hook 6*e* is positioned immediately above the load's center of gravity (in other words, the controller 30 controls the aperture of the switch valve 25 to 0%). By this means, the supply of hydraulic oil from the discharge end to the supply end of the rotating hydraulic motor 2A is stopped. As a result of this, the upper rotating body 3 stops rotating, and the hook 6*e* stops at the position immediately above the load's center of gravity. As a result of this, the swing of the load is reduced. Note that the controller 30 may close the switch valve 25 shortly before the hook 6*e* is positioned immediately above the load's center of gravity.

For example, in the event the excavator 100 is equipped with the hydraulic system shown in FIG. 4, the controller 30 controls the aperture of the switch valves 25A and 25B to a predetermined aperture greater than 0% when decelerating the rotation of the upper rotating body 3. When decelerating the rotation, the pressure at the discharge end the rotating hydraulic motor 2A is higher than that at the supply end. Consequently, when the switch valves 25A and 25B open, hydraulic oil is exhausted, on a continuous basis, from the discharge end of the rotating hydraulic motor 2A to the hydraulic oil tank, via the opening/closing valve provided at the discharge end of the rotating hydraulic motor 2A among the switch valves 25A and 25B. Also, hydraulic oil is supplied, on a continuous basis, from the hydraulic oil tank to the supply end of the rotating hydraulic motor 2A, via the opening/closing valve provided at the supply end of the rotating hydraulic motor 2A among the switch valves 25A and 25B. By this means, the upper rotating body 3 continues rotating, and the hook 6*e* moves in the direction to approach the position immediately above the load's center of gravity. Note that the predetermined aperture may be the same as when the excavator 100 is equipped with the hydraulic system shown in FIG. 3.

The controller 30 closes the switch valves 25A and 25B when the hook 6*e* is positioned immediately above the load's center of gravity. By this means, the exhaust of hydraulic oil from the discharge end of the rotating hydraulic motor 2A to the hydraulic oil tank is stopped, and the supply of hydraulic oil from the hydraulic oil tank to the supply end of the rotating hydraulic motor 2A is also stopped. As a result of this, the upper rotating body 3 stops rotating, and the hook 6*e* stops at the position immediately above the load's center of gravity. As a result of this, the swing of the load is reduced. Note that the controller 30 may close the switch valves 25A and 25B shortly before the hook 6*e* is positioned immediately above the load's center of gravity.

For example, in the event the excavator 100 is equipped with the hydraulic system shown in FIG. 5, when the controller 30 decelerates the rotation of the upper rotating body 3, the controller 30 controls the aperture of one of the proportional valves 31CL and 31CR to a predetermined aperture greater than 0%, such that the upper rotating body 3 continues rotating, and adjusts the pilot pressure that acts on the pilot ports of the control valve 173. The controller 30 controls the aperture of one of the proportional valves 31CL and 31CR in accordance with the rotating direction of the upper rotating body 3. The controller 30 determines the rotating direction of the upper rotating body 3 based on, for example, a value detected by the rotation sensor S5. The controller 30 may also determine the rotating direction of the upper rotating body 3 based on the tilt of the rotating operation lever shortly before the rotation of the upper rotating body 3 decelerates. The controller 30 may determine the rotating direction of the upper rotating body 3 based on information about the arm 5, the bucket 6, etc. recognized by the space recognition devices. By adjusting the pilot pressure that acts on the pilot ports of the control valve 173, hydraulic oil is exhausted, on a continuous basis, from the discharge end of the rotating hydraulic motor 2A to the hydraulic oil tank via the control valve 173. Also, hydraulic oil is supplied to the supply end of the rotating hydraulic motor 2A, on a continuous basis, from the center bypass pipeline C1L or the parallel pipeline C2L via the control valve 173. By this means, the upper rotating body 3 continues rotating, and the hook 6*e* moves in the direction to approach the position immediately above the load's center of gravity. Note that the predetermined aperture may be the same as when the excavator 100 is equipped with the hydraulic system shown in FIG. 3.

The controller 30 closes the proportional valves 31CL and 31CR when the hook 6*e* is positioned immediately above the load's center of gravity. By this means, the exhaust of hydraulic oil from the discharge end of the rotating hydraulic motor 2A to the hydraulic oil tank is stopped, and, furthermore, the supply of hydraulic oil from the center bypass pipeline C1L or the center bypass pipeline C2L to the supply end of the rotating hydraulic motor 2A is stopped. As a result of this, the upper rotating body 3 stops rotating, and the hook 6*e* stops at the position immediately above the load's center of gravity. As a result of this, the swing of the load is reduced. Note that controller 30 may close the proportional valves 31CL and 31CR shortly before the hook 6*e* is positioned immediately above the load's center of gravity.

Figure 6A:
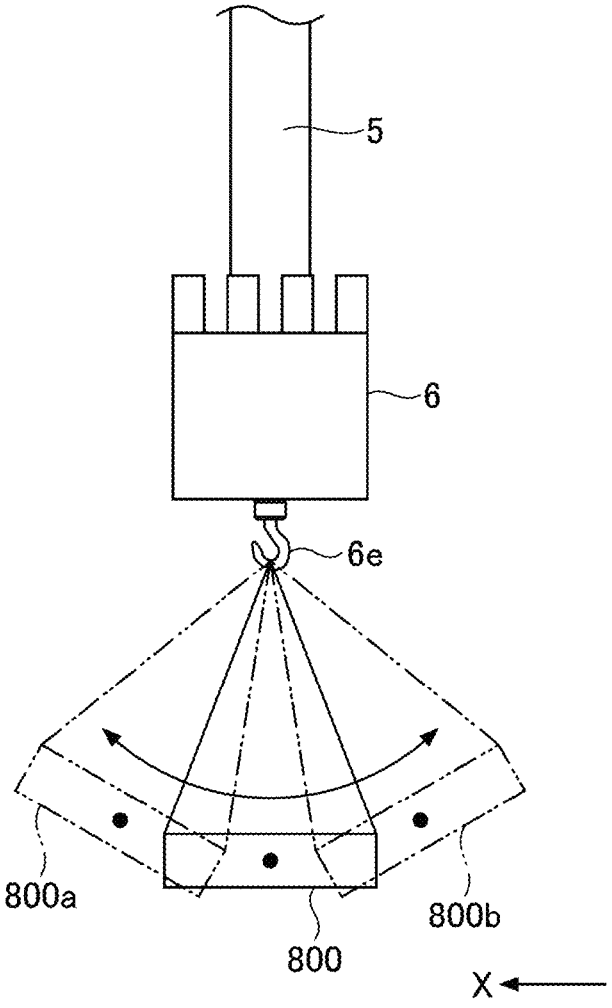
FIG. 6A is a diagram for explaining the operation of an excavator.
Figure 6B:
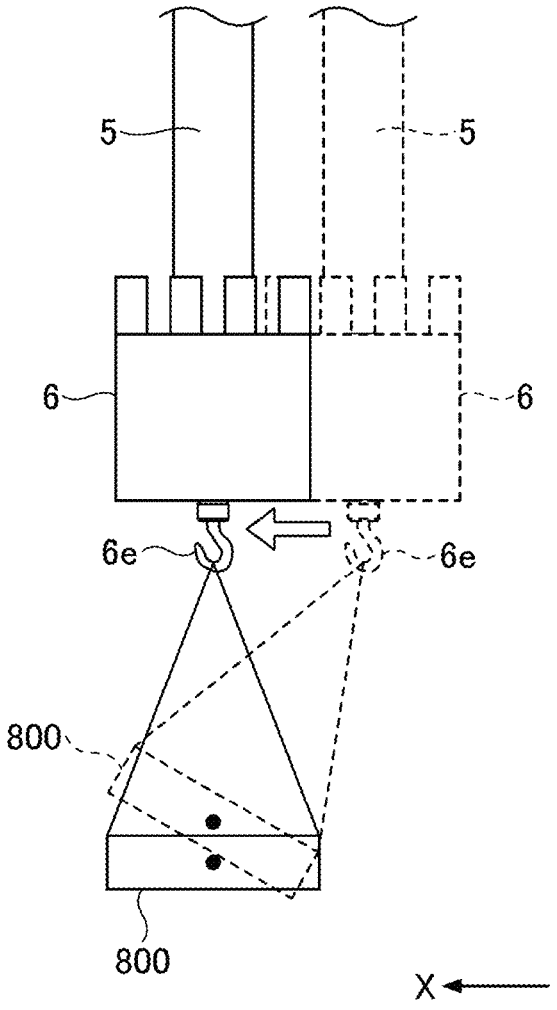
FIG. 6B is a diagram for explaining the operation of an excavator.

Next, a specific example of the operation of the anti-swing control according to the present embodiment will be described with reference to FIG. 6A and FIG. 6B. FIG. 6A and FIG. 6B are conceptual diagrams for explaining the anti-swing control according to the present embodiment. FIG. 6A is a conceptual diagram showing the swing of the load 800, and FIG. 6B is a conceptual diagram showing the operation by anti-swing control according to the present embodiment. FIG. 6B shows, with dotted lines, the arm 5, the bucket 6, the hook 6*e*, and the load 800 before the upper rotating body 3 is rotated based on anti-swing control. Note that the direction in which the upper rotating body 3 rotates will be referred to as "X direction." Also, FIG. 6B shows the position of the center of gravity of the load 800 with black circles.

Assuming that the upper rotating body 3 rotates while the load 800 is hoisted from the hook 6*e*, if the rotation of the upper rotating body 3 is decelerated then, the load 800 swings between positions 800*a* and 800*b*, as shown in FIG. 6A.

As described above, when the rotation of the upper rotating body 3 is decelerated and the load 800 is positioned ahead of the hook 6*e* in the rotating direction, the controller 30 applies anti-swing control to the rotation of the rotating body to rotate the upper rotating body 3 and bring the hook 6*e* to the position immediately above the center of gravity of the load 800. To be more specific, as shown in FIG. 6B, the upper rotating body 3 is controlled such that the hook 6*e* moves to the position immediately above the center of gravity of the load 800 at the time the amplitude of the load 800 is at its maximum. By this means, the swing of the load 800 can be reduced.

[Method of Calculating Load's Weight]

Figure 7:
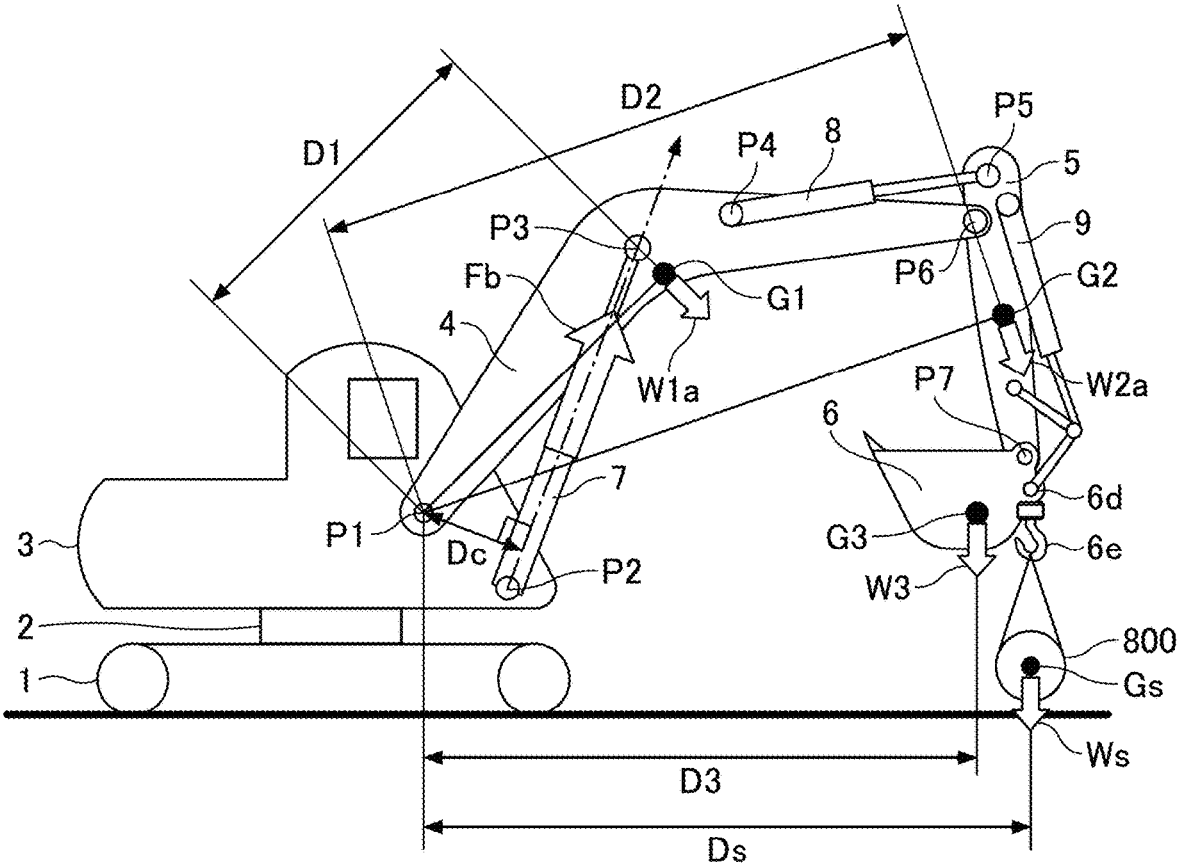
FIG. 7 is a schematic diagram for explaining parameters used to calculate the weight of load.

Next, a method of calculating the weight of the load 800 hoisted by the hook 6*e* by the load processing part 60 of the excavator 100 according to the present embodiment will be described with reference to FIG. 7. FIG. 7 is a schematic diagram for explaining the parameters used to calculate the load's weight.

Referring to FIG. 7, the pin connecting the upper rotating body 3 and the boom 4 is P1. The pin connecting the upper rotating body 3 and the boom cylinder 7 is P2. The pin connecting the boom 4 and the boom cylinder 7 is P3. The pin connecting the boom 4 and the arm cylinder 8 is P4. The pin connecting the arm 5 and the arm cylinder 8 is P5. The pin connecting the boom 4 and the arm 5 is P6. The pin connecting the arm 5 and the bucket 6 is P7. Also, the center of gravity of the boom 4 is G1. The center of gravity of the arm 5 is G2. The center of gravity of the bucket 6 is G3. The center of gravity of the load 800 hoisted by the hook 6*e* is Gs. Also, the distance between the pin P1 and the center of gravity G1 of the boom 4 is D1. The distance between the pin P1 and the center of gravity G2 of the arm 5 is D2. The distance between the pin P1 and the center of gravity G3 of the bucket 6 is D3. The distance between the pin P1 and the load's center of gravity Gs is Ds. The distance between the line connecting the pins P2 and P3 and the pin P1 is Dc. Also, the detected value of cylinder pressure of the boom cylinder 7 is Fb. Also, given the boom's weight, the vertical component that is perpendicular to the line connecting the pin P1 and the boom's center of gravity G1 is W1*a*. Likewise, given the arm's weight, the vertical component that is perpendicular to the line connecting the pin P1 and the arm's center of gravity G2 is W2*a*. The weight of the bucket 6 is W3, and the weight of the load 800 hoisted by the hook 6*e* is Ws.

As shown in FIG. 7, the position of the pin P7 is calculated from the boom angle and the arm angle. That is, the position of the pin P7 can be calculated based on values detected by the boom angle sensor S1 and the arm angle sensor S2. Also, the positional relationship between the pin P7 and the bucket's center of gravity G3 is a predetermined value. Since the hook 6*e* is positioned at the bucket pin 6*d*, the load's center of gravity Gs can be set to a position directly below the bucket pin 6*d*. The positional relationship between the pin P7 and the load's center of gravity Gs can be determined by using a predetermined slinging device or by specifying the slinging length to input to the controller 30 in technical specifications in advance. That is, the load's center of gravity Gs and the bucket's center of gravity G3 can be estimated based on bucket angle sensor S3.

That is, the load processing part 60 can estimate the load's center of gravity Gs based on values detected by the boom angle sensor S1, the arm angle sensor S2, and the bucket angle sensor S3.

Next, the balance between each moment about the pin P1 and the boom cylinder 7 can be expressed by the following mathematical expression (1):

$$WsDs + W1aD1 + W2aD2 + W3D3 = FbDc \ldots \quad (1)$$

Expanding the mathematical expression (1) with respect to the load's weight Ws gives the following mathematical expression (2):

$$Ws = (FbDc - (W1aD1 + W2aD2 + W3D3))/Ds \ldots \quad (2)$$

The detected cylinder pressure value Fb of the boom cylinder 7 is calculated by the boom-rod pressure sensor S7R and the boom-bottom pressure sensor S7B. The distance Dc and the weight of the vertical component W1*a* are calculated by the boom angle sensor S1. The weight of the vertical component W2*a* and the distance D2 are calculated by the boom angle sensor S1 and the arm angle sensor S2. The values of the distance D1 and the weight W3 are known in advance. The distance Ds and the distance D3 can also be estimated by estimating the load's center of gravity Gs and the bucket's center of gravity G3.

Therefore, the load's weight Ws can be calculated based on the detected value of the cylinder pressure of the boom cylinder 7 (values detected by the boom-rod pressure sensor S7R and the boom-bottom pressure sensor S7B), the boom angle (value detected by the boom angle sensor S1), and the arm angle (value detected by the arm angle sensor S2). By this means, the load processing part 60 can calculate the load's weight Ws based on the estimated load's center of gravity Gs.

Although an embodiment of the excavator 100 has been described above, the present disclosure is by no means limited to the above embodiment, and various modifications and improvements can be made within the scope of the gist of the present disclosure as recited in the claims attached herewith.

In the event a space recognition device (image capturing device S6) detects a person within a predetermined range around the excavator 100, the controller 30 may exert control such that an operation to move the load (operation to rotate the upper rotating body 3, for example) is not started even if the lever device is operated.

Also, the controller 30 may have a load swing detection part that detects the movement of the load hoisted by the hook 6*e*. The load swing detection part may detect the movement of the load based on values detected by the boom-rod pressure sensor S7R and the boom-bottom pressure sensor S7B, for example. Also, for example, the movement of the load may be detected by a space recognition device (image capturing device S6).

Also, when the load swings, a worker may approach the load to stop the swing of the load. The controller 30 may be structured such that, in the event the space recognition device (image capturing device S6) detects a person within a predetermined range around the excavator 100 (or load) while the load's swing is being measured, an alert such as an alarm is issued to the worker or the operator.

Also, although the excavator 100 has been described above to be structured such that it can be operated by an operator aboard the cabin 10, the excavator 100 may additionally or alternatively be structured to be operated remotely from outside the excavator 100 (remote operation). When the excavator 100 is remotely operated, the inside of the cabin 10 may be unmanned.

Figure 8:
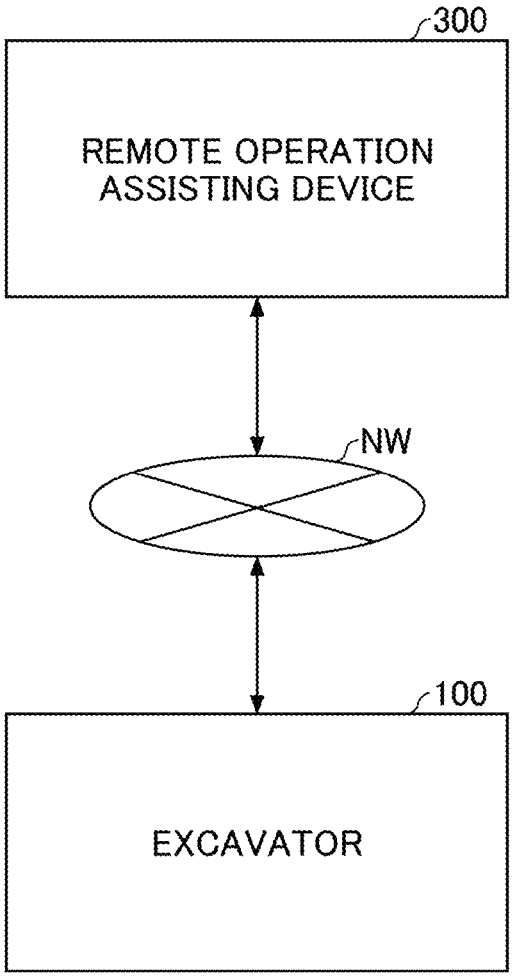
FIG. 8 is a diagram showing an example structure related to remote operation of an excavator.

FIG. 8 is a diagram showing an example structure related to remote operation of the excavator 100. As shown in FIG. 8, remote operation includes an example of operating the excavator 100 based on operations that are performed on a remote operation assisting device 300 with respect to actuators of the excavator 100 and received as inputs.

The remote operation assisting device 300 is provided, for example, in a management center from which the job of the excavator 100 is managed externally. Also, the remote operation assisting device 300 may be a portable operation terminal. In this case, the operator can operate the excavator 100 remotely while directly checking the progress of the job by the excavator 100 from the vicinity of the excavator 100.

For example, the excavator 100 may transmit images showing the surroundings of the excavator 100 (hereinafter referred to as "surrounding images"), including the front of the excavator 100, based on images captured and output by the image capturing devices S6 to the remote operation assisting device 300 through the communication device T1. Then, the remote operation assisting device 300 may display the images (surrounding images) received from the excavator 100 on the display device. Also, various information images (information screen) displayed on the display device 40 inside the cabin 10 of the excavator 100 may be similarly displayed on the display device of the remote operation assisting device 300. By this means, the operator using the remote operation assisting device 300 can remotely operate the excavator 100 while checking, for example, images showing the surroundings of the excavator 100 displayed on the display device and the content displayed on the information screen. Then, the excavator 100 may move the actuators and drive the elements to be driven such as the lower traveling body 1, the upper rotating body 3, the boom 4, the arm 5, and the bucket 6, based on remote operation signals indicating the details of remote operations received by the communication device T1 from the remote operation assisting device 300.

Also, remote operations may include an example of operating the excavator 100 by external voice input or gesture input to the excavator 100 from people (for example, workers) around the excavator 100. To be more specific, the excavator 100 recognizes voices uttered by nearby workers and gestures made by workers through a sound input device (for example, a microphone) or a gesture input device (for example, an image capturing device) mounted on the excavator 100. Then, the excavator 100 may move the actuators according to the details of the voice and gesture recognized, and the drive elements to be driven such as the lower traveling body 1 (left and right crawlers), the upper rotating body 3, the boom 4, the arm 5, and the bucket 6.

Also, the excavator 100 may automatically move the actuators regardless of the details of the operator's operations. By this means, the excavator 100 can implemented a function ("auto operation function" or "MC (Machine Control) function") to automatically operate at least some of the elements to be driven, such as the lower traveling body 1, the upper rotating body 3, the boom 4, the arm 5, and the bucket 6.

The auto operation function includes, for example, a function ("semi-auto operation function" or "operation-assisting MC function") to automatically operate elements (actuators) to be driven other than the element (actuator) for which a particular operation is made and which is therefore the target element to be driven, depending on the operation performed by the operator on the operating device 26 or through remote operation. Also, the auto operation function may include a function ("complete auto operation function" or "fully automatic MC function") to automatically operate at least some of multiple elements (actuators) to be driven, assuming that no operation is performed by the operator on the operating device 26 or through remote operation. When the complete auto operation function is activated in the excavator 100, the inside of the cabin 10 may be unmanned. Also, the semi-auto operation function and the complete auto operation function may include a mode in which the details of operations in which the element (actuators) that is the target of automatic operation and that is therefore to be driven are determined automatically according to predefined rules. Also, the semi-auto operation function and the complete auto operation function may include a mode ("autonomous driving function") in which the excavator 100 autonomously makes various decisions and autonomously determines, based on the decision results, the details of operations in which the element (actuator) that is the target of automatic operation and that is therefore to be driven.

Also, the job that the excavator 100 performs may be monitored remotely. In this case, a remote monitoring assisting device having a similar function to that of the remote operation assisting device 300 may be provided. By this means, a supervisor, who is the user of the remote monitoring assisting device, can monitor the progress of the job by the excavator 100 by checking the surrounding images displayed on the display device of the remote monitoring assisting device. For example, if the supervisor judges it necessary from the perspective keeping safety, he/she can intervene in the operation of the excavator 100 by the operator and force the excavator 100 to a stop by making a predetermined input using an input device of the remote monitoring assisting device.

The work machine according to the present embodiment has been described based on an example in which the excavator 100 has a bucket 6 as an end attachment, but this is by no means a limitation. The work machine may, for example, have a grapple as an end attachment, a work have a lifting magnet as an end attachment, etc., but this is by no means a limitation. The work machine may be, for example, a crane.

Figure 9:
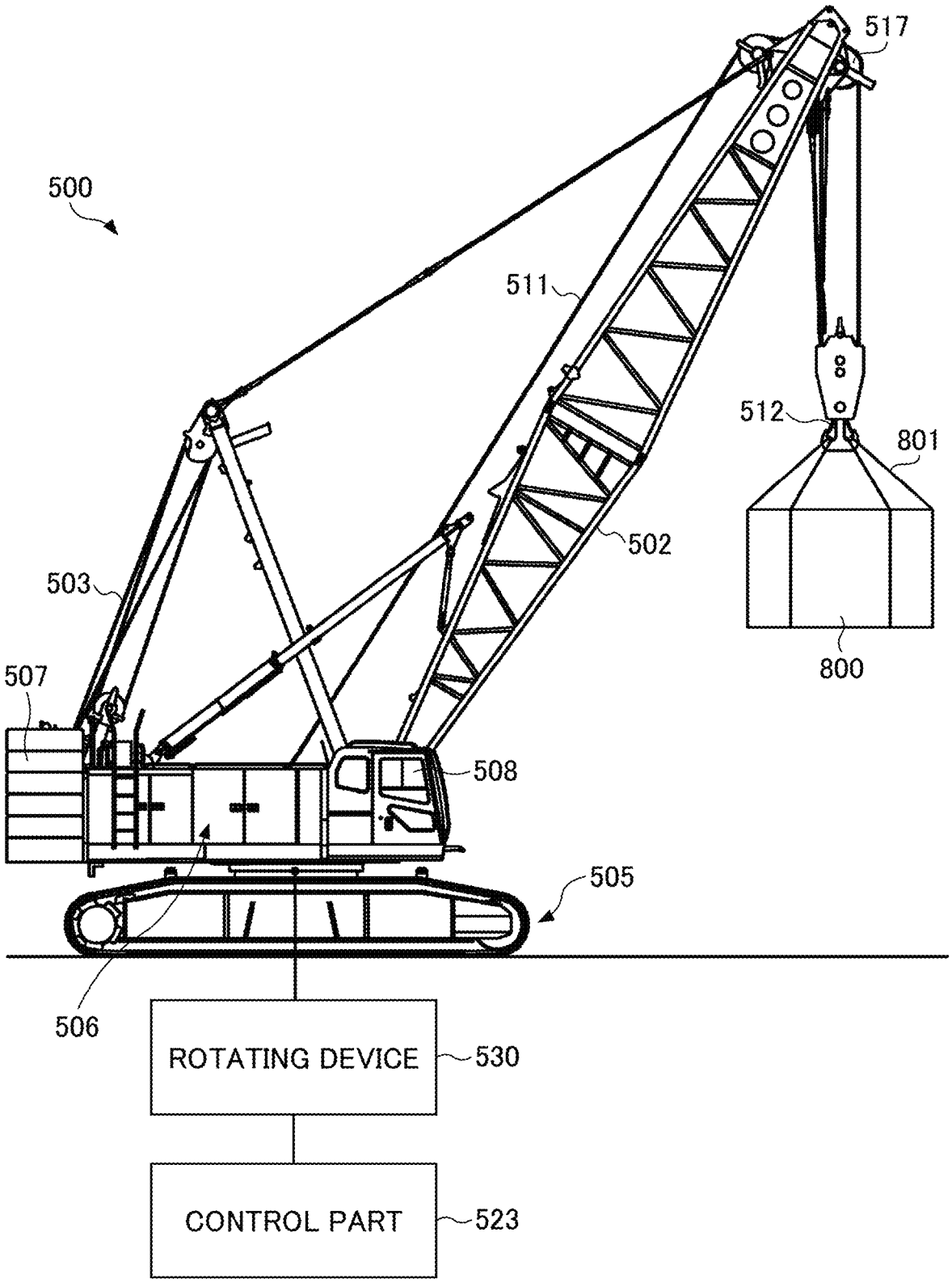
FIG. 9 is a side view of a crane.
Figure 10:
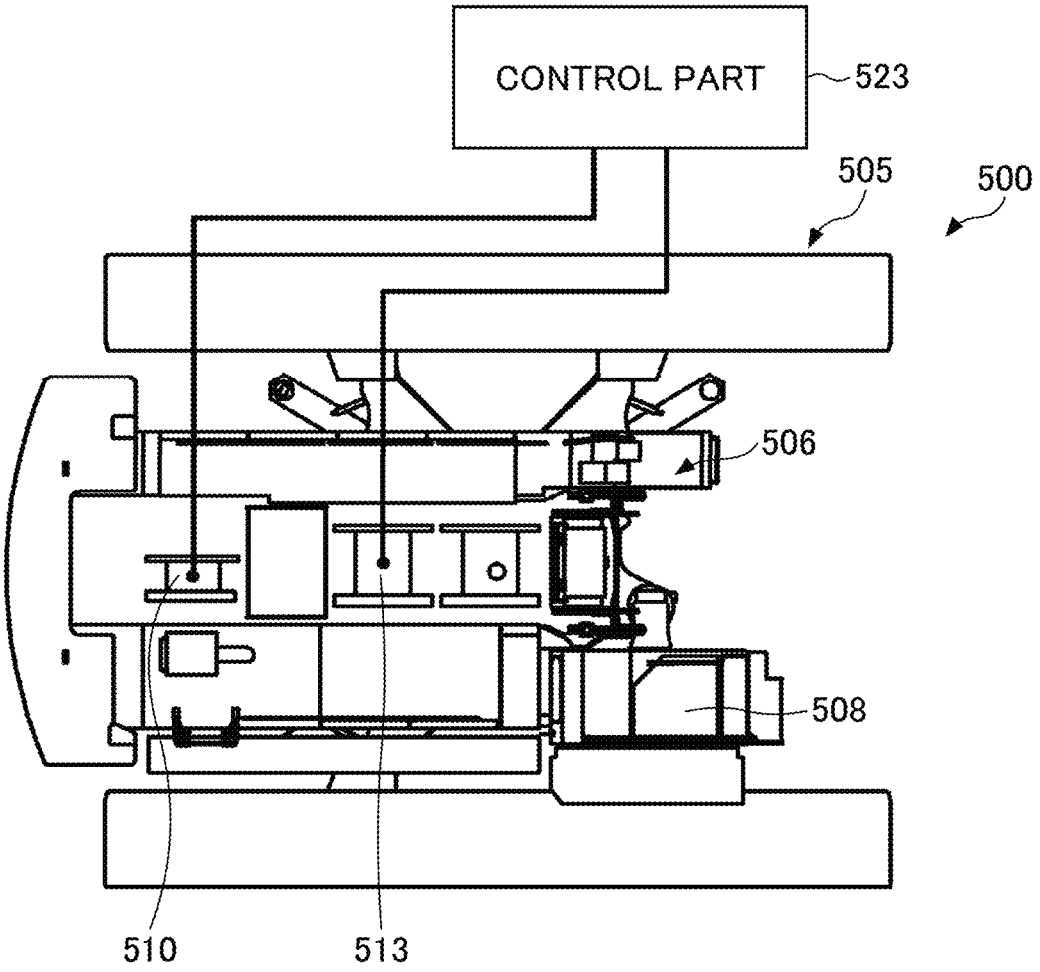
FIG. 10 is a plan view of a crane.

An overview of a crane 500, which is another example of a work machine according to the present embodiment, will be described below with reference to FIG. 9 and FIG. 10. FIG. 9 is a side view of the crane 500. FIG. 10 is a plan view of the crane 500. Some parts of the crane 500 (boom 502, hoisting rope 503, etc.) are omitted in FIG. 10.

As shown in FIG. 9 and FIG. 10, crane 500 is what is known as a mobile crawler crane. The crane 500 includes a self-propelled crawler-type lower traveling body 505 and an upper rotating body 506 rotatably mounted on the lower traveling body 505. In the following description, the front-back direction and the left-right direction as seen from the operator of the crane 500 will be described as the front-back direction and the left-right directions of the crane 500.

The boom 502 is attached to the front of the upper rotating body 506 so that it can be raised and lowered. A counterweight 507 is attached to the rear of the upper rotating body 506 to balance the weight between the boom 502 and the load. A cabin 508 is located at the front right side of the upper rotating body 506 where the operator sits and operates the crane 500.

The raising and lowering of the boom 502 is performed by a crane winch 510 winding in and unwinding the hoisting rope 503.

One end of a hoisting rope 511 is connected to a hook 512, and the hook 512 is suspended by the hoisting rope 511 wound around a point sheave 517 at the tip of the boom 502. The other end of the hoisting rope 511 is wound around a wind winch 513 on the upper rotating body 506, and the hoisting rope 511 is wound in or unwound by the drive of the wind winch 513, and the hook 512 goes up and down. The load 800 is hoisted from the hook 512 by a string-like, chain-like hoisting material 801.

The crane 500 has a control part 523. The control part 523 is constituted by, for example, a CPU, and controls the operation of each part of the crane 500. The control part 523 has the functions of an ECU (Electronic Control Unit) and is provided in the upper rotating body 506. The control part 523 operates the crane winch 510, the wind winch 513, the rotating device 530 of the upper rotating body 506, and various other motors and actuators based on operations and the like input by the operator.

Figure 11A:
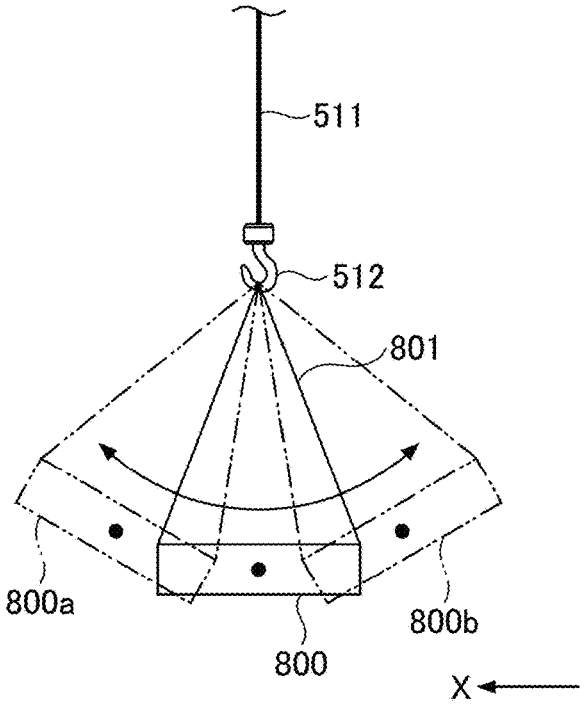
FIG. 11A is a diagram for explaining the operation of a crane.
Figure 11B:
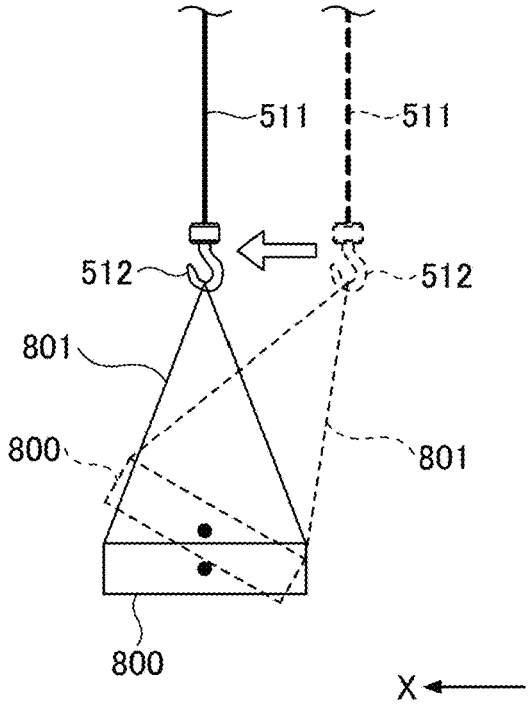
FIG. 11B is a diagram for explaining the operation of the crane.

Next, specific example operations based on anti-swing control in the crane 500 shown in FIG. 9 and FIG. 10 will be described with reference to FIG. 11A and FIG. 11B. FIG. 11A and FIG. 11B are diagrams for explaining the operation of the crane 500. FIG. 11A is a conceptual diagram showing the swing of load 800, and FIG. 11B is a conceptual diagram showing the operation of the crane 500 based on anti-swing control. In FIG. 11B, the hoisting rope 511, the hook 512, the load 800, and the hoisting material 801 before the upper rotating body 506 rotates based on anti-swing control are shown by dotted lines. Note that the rotating direction of the upper rotating body 506 will be referred to as the X direction. Also, the position of the center of gravity of the load 800 is shown by black circles.

Assuming that the upper rotating body 3 rotates while the load 800 is hoisted from the hook 512, if the rotation of the upper rotating body 506 is decelerated then, the load 800 swings between the positions 800*a* and 800*b*, as shown in FIG. 11A.

When the rotation of the upper rotating body 506 is decelerated and the load 800 is positioned ahead of the hook in the rotating direction 512, the control part 523 applies anti-swing control to the rotation of the rotating body to rotate the upper rotating body 506 and bring the hook 512 to the position immediately above the center of gravity of the load 800. To be more specific, as shown in FIG. 11B, the upper rotating body 506 is controlled such that the hook 512 moves to the position immediately above the center of gravity of the load 800 at the time the amplitude of the load 800 is at its maximum. By this means, the swing of the load 800 can be reduced.

Note that the hydraulic system that rotates the upper rotating body 506 in the crane 500 may be the same or substantially the same as the hydraulic system that rotates the upper rotating body 3 in the excavator 100.

What is claimed is:

1. A work machine comprising:

a traveling body;

a rotating body rotatably mounted on the traveling body;

an attachment attached to the rotating body, the attachment including a hook for hoisting a load;

a rotating hydraulic motor with a first port and a second port, the rotating hydraulic motor being configured to rotate the rotating body;

a hydraulic pressure sensor configured to detect pressures of hydraulic oil at the first port and the second port; and a hardware processor configured to, when the load is positioned ahead of the hook in a rotating direction of the rotating body upon deceleration of rotation of the rotating body, execute anti-swing control on the rotation of the rotating body such that the hook is positioned immediately above a center of gravity of the load, wherein the hardware processor is configured to execute the anti-swing control according to the pressures of hydraulic oil at the first port and the second port detected by the hydraulic pressure sensor.

2. The work machine according to claim 1, further comprising a switch configured to switch between an activated mode in which the anti-swing control is activated and a deactivated mode in which the anti-swing control is deactivated.

3. The work machine according to claim 1, further comprising an operating device configured to operate the rotating body, wherein the hardware processor is configured to execute the anti-swing control when the operating device is in a neutral position.

4. The work machine according to claim 1, wherein the hardware processor is configured to execute the anti-swing control when an amplitude of swing of the load is at a maximum.

5. The work machine according to claim 1, further comprising:

a first pipeline connecting the first port and the second port; and a first switch valve configured to control a flow rate of hydraulic oil in the first pipeline, wherein the hardware processor is configured to, using the first switch valve, control the flow rate of hydraulic oil in the first pipeline to execute the anti-swing control.

6. The work machine according to claim 1, further comprising:

a second pipeline connecting the first port and a hydraulic oil tank;

a second switch valve configured to control a flow rate of hydraulic oil in the second pipeline;

a third pipeline connecting the second port and the hydraulic oil tank; and a third switch valve configured to control a flow rate of hydraulic oil in the third pipeline, wherein the hardware processor is configured to, using the second switch valve and the third switch valve, control the flow rate of hydraulic oil in the second pipeline and the third pipeline to execute the anti-swing control.

7. The work machine according to claim 6, wherein the hardware processor is configured to, during the deceleration of rotation of the rotating body, open the second switch valve and the third switch valve to (a) continuously discharge hydraulic oil from one of the first port and the second port on a discharge side of the rotating hydraulic motor to the hydraulic oil tank via one of the second switch valve and the third switch valve on the discharge side of the rotating hydraulic motor and (b) continuously supply hydraulic oil from the hydraulic oil tank to the other of the first port and the second port on a supply side of the rotating hydraulic motor via the other of the second switch valve and the third switch valve on the supply side of the rotating hydraulic motor.

8. The work machine according to claim 1, further comprising:

a control valve configured to control the rotating hydraulic motor, wherein the hardware processor is configured to control the control valve to execute the anti-swing control.

9. The work machine according to claim 1, further comprising:

a first switch configured to switch a work mode of the work machine according to a type of work to be performed by the work machine; and a second switch configured to switch a mode of the anti-swing control between an activated mode in which the anti-swing control is activated and a deactivated mode in which the anti-swing control is deactivated.

10. A work machine comprising:

a traveling body;

a rotating body rotatably mounted on the traveling body;

an attachment attached to the rotating body, the attachment including a hook for hoisting a load; and a hardware processor configured to, when the load is positioned ahead of the hook in a rotating direction of the rotating body upon deceleration of rotation of the rotating body, execute anti-swing control on the rotation of the rotating body such that the hook is positioned immediately above a center of gravity of the load, wherein the hardware processor is configured to calculate a rotational moment of the rotating body about a rotating axis, using a weight of the load and a radius of rotation of the attachment, and to execute the anti-swing control based on the calculated rotational moment of the rotating body.

* * * * *